United States Patent [19]

Macemon et al.

[11] Patent Number: 4,699,184

[45] Date of Patent: Oct. 13, 1987

[54] APPARATUS AND METHOD FOR FABRICATING A HIGH VOLTAGE WINDING FOR A TOROIDAL TRANSFORMER

[75] Inventors: Herbert J. Macemon, Versailles; Randall L. Schlake, Lexington, both of Ky.

[73] Assignee: Kuhlman Corporation, Troy, Mich.

[21] Appl. No.: 863,633

[22] Filed: May 15, 1986

[51] Int. Cl.[4] ..... B21F 3/00

[52] U.S. Cl. ..... 140/92.2; 242/7.13

[58] Field of Search ..... 72/142, 144; 242/7.13, 242/7.14, 7.15; 140/92.2; 29/605

[56] References Cited

U.S. PATENT DOCUMENTS

| | | | |
|---|---|---|---|
| 823,265 | 6/1906 | De Planque et al. . | |
| 839,060 | 12/1906 | Dunn . | |
| 1,995,916 | 3/1935 | Collins . | |
| 2,877,807 | 3/1959 | Robertson | 140/92.2 |
| 2,961,174 | 11/1960 | Birchler et al. . | |
| 3,166,104 | 1/1965 | Foleg et al. . | |
| 3,387,634 | 6/1968 | Hilsenberg | 140/92.2 |
| 3,799,462 | 3/1974 | Fahrbach . | |
| 3,881,526 | 5/1975 | Bell et al. . | |
| 3,989,200 | 11/1976 | Bachi . | |

*Primary Examiner*—Lowell A. Larson

*Attorney, Agent, or Firm*—Townsend and Townsend

[57] ABSTRACT

A toroidal electrical transformer having a low voltage coil, a high voltage coil and an annular magnetic core is disclosed. The preferred low voltage and high voltage coils are each continuous and form an arcuate elongated passage therethrough. The preferred annular magnetic core is wound in place in said arcuate elongated passage substantially from a continuous strip of magnetic material resulting in a toroidal transformer with cotinuous windings and a continuous wound core. Various components and sub-assemblies are also disclosed along with various apparatus and methods for producing such toroidal electrical transformers, its components and its sub-assemblies.

8 Claims, 36 Drawing Figures

Fig-2
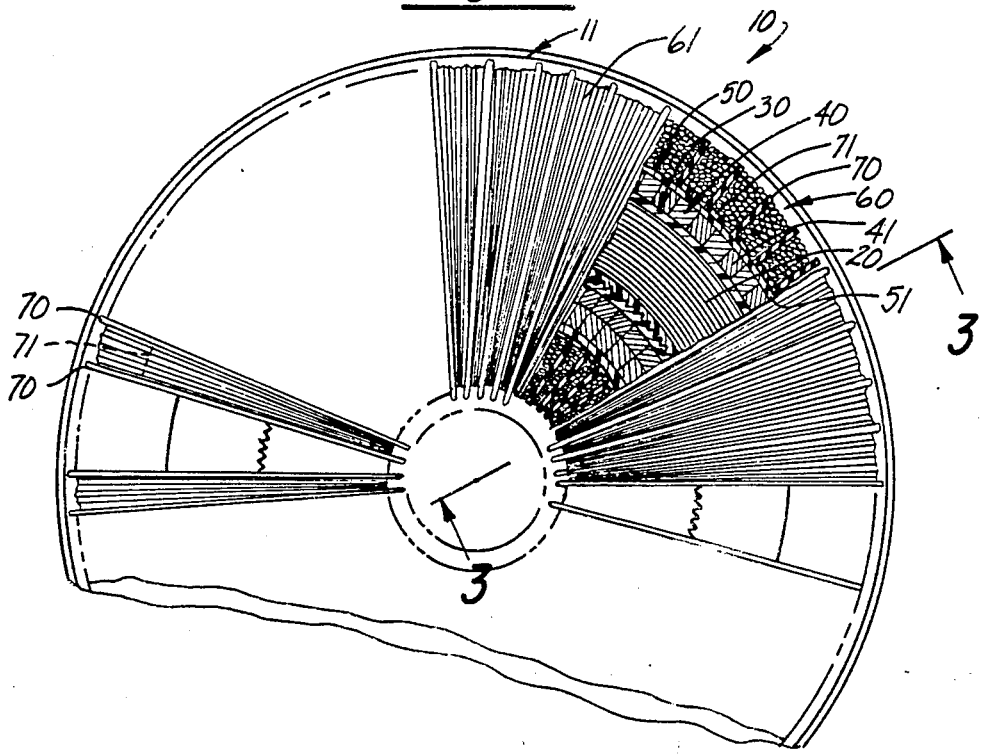
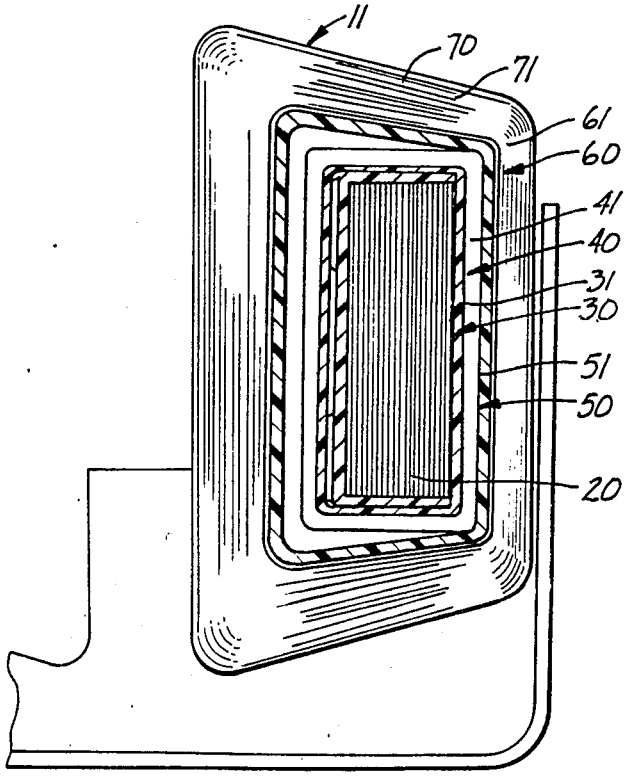
Fig-3

Fig-4
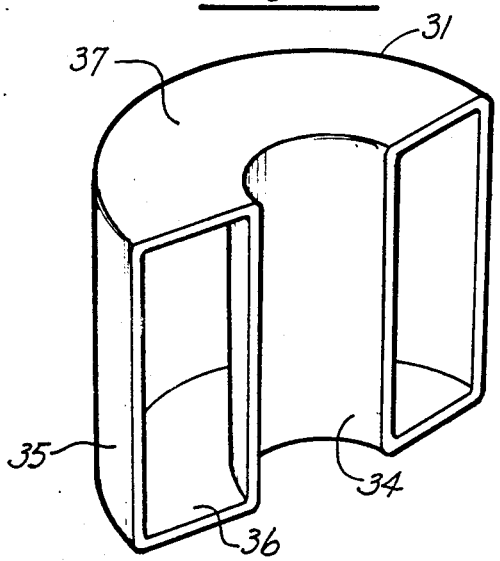
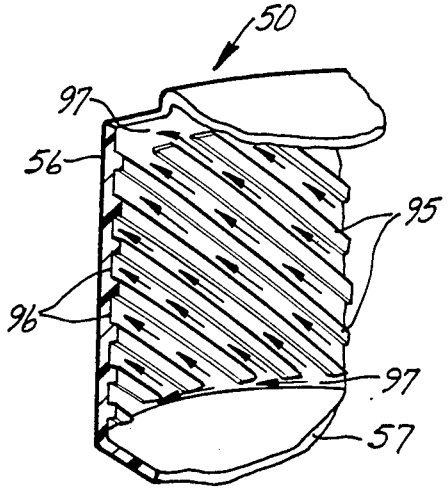
Fig-4a
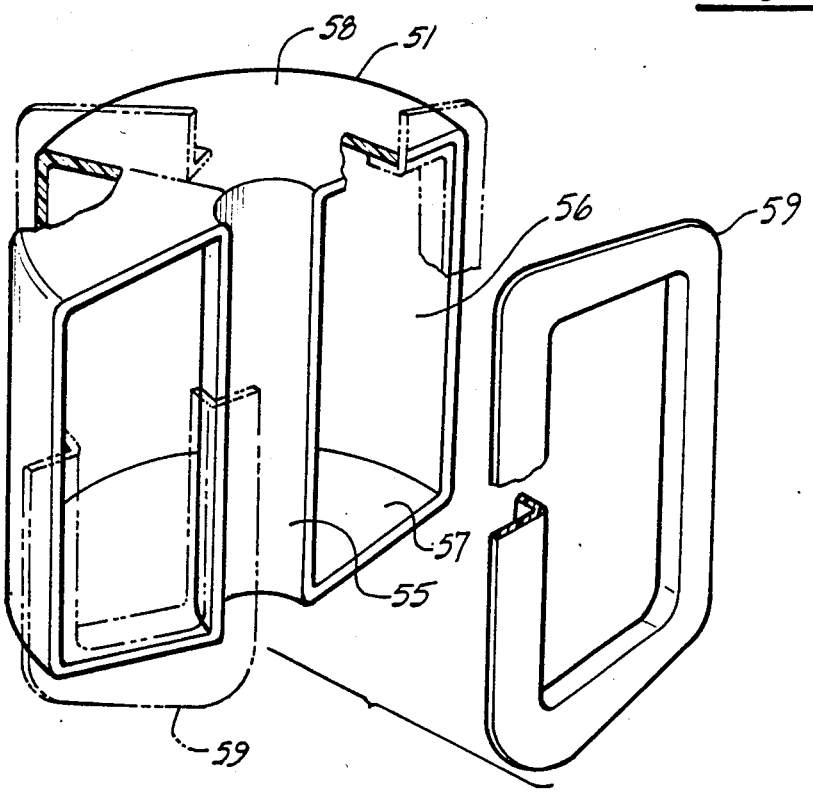
Fig-5

APPARATUS AND METHOD FOR FABRICATING A HIGH VOLTAGE WINDING FOR A TOROIDAL TRANSFORMER

BACKGROUND OF THE INVENTION

The present invention constitutes both improvements to and additional inventions over the inventions disclosed in the following co-pending patent applications: application Ser. No. 005,326, filed Jan. 15, 1987, being a continuation of application Ser. No. 06/750,045, filed June 27, 1985, and being a continuation of application Ser. No. 06/337,356, filed Jan. 6, 1982, entitled "Toroidal Electrical Transformer and Method of Producing Same", and application Ser. No. 06/662,312, filed Oct. 17, 1984, entitled "Apparatus and Method for Fabricating a Low Voltage Winding for a Toroidal Transformer", and application Ser. No. 06/867,411, filed May 15, 1986, being a continuation of application Ser. No. 06/662,467, filed Oct. 17, 1984, entitled "Apparatus and Method for Fabricating a High Voltage Winding for a Toroidal Transformer", and application Ser. No. 07/011,454, filed Feb. 6, 1987, being a continuation of application Ser. No. 06/662,330, filed Oct. 17, 1984, entitled "Apparatus and Method for Winding a Magnetic Core for a Toroidal Transformer", and application Ser. No. 06/698,981, filed Feb. 6, 1985, entitled "Apparatus and Method for Fabricating a Low Voltage Winding for a Toroidal Transformer", and application Ser. No. 06/698,982, filed Feb. 6, 1985, entitled "Apparatus and Method for Winding a Toroidal Magnetic Core onto a Bobbing for a Toroidal Transformer". The entirety of the disclosure of said co-pending applications are incorporated herein by reference thereto.

SUMMARY OF THE INVENTION

In general, this Application and the afore-mentioned copending Application are directed to new toroidal transformer designs and construction apparatus and methods which improve the efficiency of the transformer in several respects. For example, the inventions provide a toroidal transformer which is highly energy efficient in that the loss of electrical energy to heat is reduced both during periods of power conversion and periods of idling with little or no power conversion. Improved energy efficiency is obtained through both lower core losses and lower winding losses. Secondly, the transformer is volumetrically efficient in that a transformer with a given power rating has a relatively small volume and an advantageous cylindrical configuration, being therefore well suited for tank enclosures. Thirdly, the transformer is materials efficient in that a minimal amount of costly construction materials are required to manufacture the transformer. Fourthly, the transformer is manufacturing efficient in that it can be manufactured with efficient and highly-automated processes using a minimum of expensive manual labor. Fifthly, it is design efficient in that a wide variety of power ratings and utility requirements can be met with the same basic design produced on the same basic machines. Sixthly, it is thermally-efficient in that there is good thermal transfer from the heat producing components to an oil bath in which the transformer resides without need for special cooling devices. Seventhly, it is mechanically efficient since the toroidal shape is readily supported to reduce the possibilities of damage during transportation, installation and use. For example, the good mechanical mounting characteristics provides a sturdy structure having good resistance to shock forces applied to the transformer during short circuit conditions. Eighthly, it is noise efficient since the core is uncut and uses steel which is rolled in the direction of the flux path within the core thereby reducing noise generated either by high-magnetic induction at core cuts or by magneto-striction effects. Ninthly, it is aging efficient since both low thermal gradients and low hot spot temperatures contribute to a long life without substantial degradation of performance. Tenthly, it is E.M.I. efficient since its uncut core lowers exciting currents which in turn lower electromagnetic interference of telephone communications and the like.

The present invention differs from the invention of said copending application in a number of significant respects. Exemplary of those differences, but not inclusive of all such differences, are the following.

The present invention provides a high voltage coil winding machine and method which winds conductor into a cavity in a winding mandrel having sides converging towards the opening of the cavity, and which has guide means for accurately positioning the conductor within the cavity as the mandrel rotates, even though the guide means is located outside the cavity and does not move radially or tilt about the axis of the wire extending from the guide means to the mandrel. Particularly, the present invention positions the guide means in accordance with the positions of both the inside leg and the outside leg of the turn being wound.

Preferably, the inside leg and the outside leg of the turn being wound are disposed in parallel so as to define a plane in which the departure point of the wire from the guide means is located during winding of the portion of a turn which includes the inside leg. The converging yoke leg extending from the outside leg to the inside leg is radially disposed relative to the point of convergence of the sides of the pre-shaped wire cavity, or alternatively, is radially disposed relative to the midpoint of the narrow entrance to the inside leg of the pie-shaped wire cavity when that entrance is approximately one wire diameter in width. All transistors between the plane defined by the inside and outside legs of one turn (N) to the plane defined by the inside and outside legs of the next turn (N+1) occur in the diverging yoke leg between the inside leg and the outside leg.

Since the plane defined by the inside and outside legs of a turn is typically tilted relative to the axis of rotation of the mandrel, the wire guide means must traverse back and forth along the axis of rotation of the mandrel in a generally sinusoidal-like manner. This motion can be approximated by defining points along the path of motion of the wire guide means and transition rates in between those points, and is conveniently accomplished by conventional numerical control programs and controllers.

The features and advantages of the products, methods and machines described in the specification are not all-inclusive, many additional features and advantages being apparent to one of ordinary skill in the art in view of the drawings, specification and claims hereof. Moreover, it should be noted that the language used in the specification has been principally selected for readability and instructional purposes, and may not have been selected to delineate or circumscribe the inventive subject matter, resort to the claims being necessary to determine such inventive subject matter.

BRIEF DESCRIPTION OF THE FIGURES

FIG. 2 is a partially cut-away top view of the toroidal electrical transformer of FIG. 1, less the transformer support structure.

FIG. 3 is a cross-sectional view of a portion of the toroidal electrical transformer taken along line 3—3 of FIG. 2, less the transformer support structure.

FIG. 4 is a perspective view of one section of the preferred core insulation tube of the present invention.

FIG. 4*a* is a fragmented perspective view of one of the insulation members of the preferred toroidal electrical transformer, illustrating a preferred cooling fluid channel structure.

FIG. 5 is an exploded perspective view of one section of the preferred high/low insulation barrier of the present invention.

FIG. 11 is a side elevation view of the mandrel and wire placement subassembly at an initial stage in the winding of a high voltage coil.

FIG. 12 is a side elevation view of the mandrel and wire placement subassembly at a later stage in the winding of a high voltage coil.

FIG. 13 is a side elevation view of the mandrel and wire placement subassembly at a later stage in the winding of a high voltage coil.

FIG. 14 is a side elevation view of the mandrel and wire placement subassembly at a later stage in the winding of a high voltage coil.

DESCRIPTION OF THE SPECIFIC EMBODIMENTS

The figures depict various preferred embodiments of the present invention for purposes of illustration only. One skilled in the art will readily recognize from the following discussion that alternative embodiments of the structures and methods illustrated herein may be employed without departing from the principles of the invention described herein.

Figure 1:
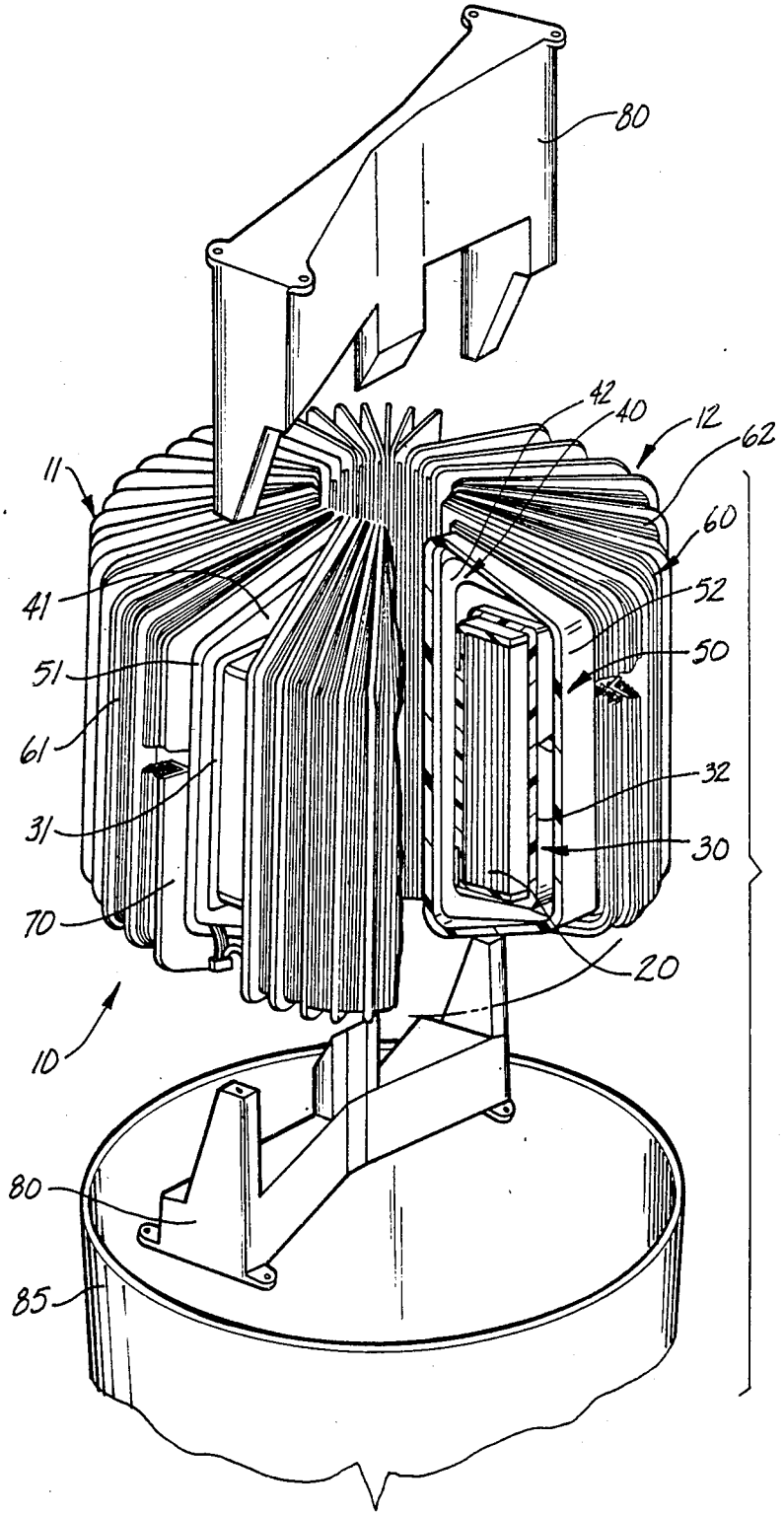
FIG. 1 is a partially cut-away, partially exploded, perspective view of a preferred toroidal electrical transformer according to the present invention.

FIGS. 1 through 3 illustrate a preferred toroidal electrical transformer 10 including a continuously wound, toroidal or annular core 20 disposed within a core insulation tube 30. A low voltage coil or winding 40 surrounds the core insulation tube 30 and is encased by a high/low insulation barrier 50, which is in turn surrounded by a high voltage coil or winding 60.

The high voltage winding 60 is preferably made up of two substantially semi-toroidal sections 61 and 62, each including a plurality of pie or wedge shaped bundles or coils continuously wound from a common wire and connected by loops of said common wire, e.g., twenty 8.25° coils forming in total an arc of about 165° in each of said semi-toroidal sections. At least the coils of the high voltage winding 60 near the ends of the sections 61 and 62 are preferably separated by insulating inserts or collars 70, around which said loops extend, for purposes of resisting impulse stresses resulting from any non-linear voltage distribution to which the high voltage winding may be subjected, such as those encountered during high voltage impulses caused, for example, by lightning. Such inserts 70 may in some cases be required between all high voltage winding segments as shown in the drawings, or more than one insert may be required between each segment. The inserts 70 include a radial flange separating the adjacent coils of the high voltage winding 60 and are preferably composed of a moldable paper board, Kraft paper or a synthetic insulator material, such as "MYLAR" or "KAPTON". The inserts 70 are retained in place by molded cuffs or flanges 71 which extend axially and circumferentially under the high voltage winding segments as shown in FIG. 2.

Similarly, the preferred low voltage winding 40 is also made up of two substantially semitoroidal sections 41 and 42, corresponding to the high voltage winding sections 61 and 62. Such preferred low voltage coil sections 41 and 42 may each include either a singular winding conductor, bifilar or multifilar parallel conductors in an interleaved configuration, one of such parallel conductors for each voltage winding, as is explained in detail below. In the preferred embodiment, as shown in the drawings, the high voltage winding sections 61 and 62 and the low voltage winding sections 41 and 42 each extend circumferentially through an arc of approximately 165 degrees on each side of the transformer 10. Correspondingly, the core insulation tube 30 and the high/low insulation barrier 50 are each formed in two semi-toroidal sections, with each of the sections extending circumferentially through an arc of approximately 165 degrees on each of the two sides of the preferred transformer 10. Thus, the low voltage coil 40 is preferably disposed within the high voltage coil 60, and the two coils preferably encompass approximately 165 degrees of the circumferential length of the toroidal or annular core 20.

The term "continuous" as used herein in connection with the high voltage winding or coil 60, and the sections 61 and 62 thereof, includes a preferred configuration wherein the pie-shaped bundles or coils and the connecting loops are wound and formed from a single wire or conductor that is continuous over the length of each of the high voltage coil sections 61 or 62, or in other words, over substantially one-half of the toroidal transformer 10. Such term "continuous" also refers to various alternate configurations of the high voltage coil 60, wherein at least each pie-shaped coil is wound from such a continuous wire or conductor.

With respect to the low voltage winding or coil 40, and the sections 41 and 42 thereof, the term "continuous" includes the above-mentioned preferred singular, bifilar or multifilar arrangements, wherein the conductor is continuous over the length of each of the low voltage coil sections 41 or 42. Thus in such preferred embodiment, the low voltage coil is continuous over substantially one-half of the toroidal transformer 10. The term "continuous" also includes any of several alternative low voltage coil structures wherein at a minimum the low voltage conductor, whether singular, multifilar, or otherwise, and whether interleaved or not, is continuous over at least three turns thereof.

The term "continuous," as used with reference to the magnetic core 20, includes such core structures wound from a single or multifilar group of ribbon-like strips of continuous core material as well as a successive, serially-connected group of core material strips, wound-in successively to form increasingly large diametric regions of the core 20. Accordingly, while in the preferred embodiment a single strip of core material forms the wound core, the term "continuous" contemplates plural strips of core material which are wound through a substantial number of turns greater than two to provide a wound core.

The terms "toroidal" or "annular" as used herein in connection with the high and low voltage coils 60 and 40, respectively, and in connection with the magnetic core 20, refer to the configuration of a torus generated by the revolutions of any of a number of regular or irregular shapes about an external axis. The various preferred structures and configurations of the high and low voltage windings or coils 60 and 40, respectively, and of the magnetic core 20 are described in detail below.

FIG. 4 represents a detailed view of the section 31 of a preferred core insulation tube or barrier 30 comprising two semi-toroidal sections 31 and 32 (the latter not shown). Although only section 31 is shown in FIGS. 4 and 4*a* for purposes of illustration, one skilled in the art will appreciate that the section 32 is identical to the section 31.

The core insulation tube section 31 is preferably molded from an insulating and moldable paper board, Kraft paper or synthetic insulation material and each section is identical with respect to each other. Thus, the two identical sections required to form the core insulation tube 30 may be molded from a single mold. The sections 31 are preferably molded from a suitable moldable paper board as known in the art or high-strength, glass-filled synthetic material, such as polyester, nylon, or epoxy, for example.

The sections 31 of the core insulation tube 30 each include inner and outer walls 34 and 35, respectively, extending in an axial direction between a base portion 36 and a top portion 37. It is preferable to construct each section in one piece for improved insulation performance.

FIG. 5 shows the preferred section 51 of the high/low insulation tube or barrier 50, comprising two semi-toroidal sections 51 and 52. One skilled in the art will readily understand that section 52 is identical to section 51. The section 51 of the high/low insulation barrier 50 may be molded in one piece from a moldable paper board or a suitable reinforced synthetic insulation material. A set of inner and outer walls, 55 and 56, respectively, extend axially between a base portion 57 and a top portion 58.

The particular cross-sectional shapes of the generally toroidal or annular shaped core insulation tube 30 and high/low insulation barrier 50 correspond to the desired cross-sectional shapes of the toroidal or annular magnetic core 20 and high and low voltage coils 60 and 40, respectively.

The sections 51 and 52 of insulation tube 50 are each preferably provided with end cuffs 59, which mate with the ends of each such section as illustrated in FIG. 5. To this end, the end cuffs 59 are provided with circumferentially extending flanges which closely fit with the interior of the insulation sections 51, 52. Each cuff has a radial flange which acts as an added barrier against electrical breakover during high voltage conditions.

FIG. 4*a* illustrates a broken-away portion of the high/low insulation barrier 50 including a preferred but optional internal wall structure of the present invention. The wall structure shown in FIG. 4*a* and the related discussion herein are equally applicable to the core insulation tube 30.

Transformers of the type disclosed herein frequently employ oil or other fluids, either liquid or gaseous, for cooling their components during operation. Such cooling fluid is typically an electrical grade insulating oil. The high/low insulation barrier 50 in FIG. 4*a* includes a number of ridges 95 molded into the internal side of the outer wall 56. The ridges 95 may be inclined, spiral, involute, or the like, and form a plurality of cooling fluid branch channels 96 therebetween. The ridges 95 are interrupted short of the base portions 57 and thereby form common header channels 97 at the upper and lower peripheries of the outer wall 56. The branch channels 96 and the header channels 97 act as conduits for the convective flow of the cooling liquid. The configuration of the ridges 95, being inclined or spiral, etc., imparts convectively induced circulating motion to the cooling fluid flow throughout the inside of the high/low insulation barrier 50, as illustrated by the flow arrows in FIG. 4*a*. Such circulating motion promotes both cooling of the components and uniform temperature distribution throughout the transformer.

Figure 6:
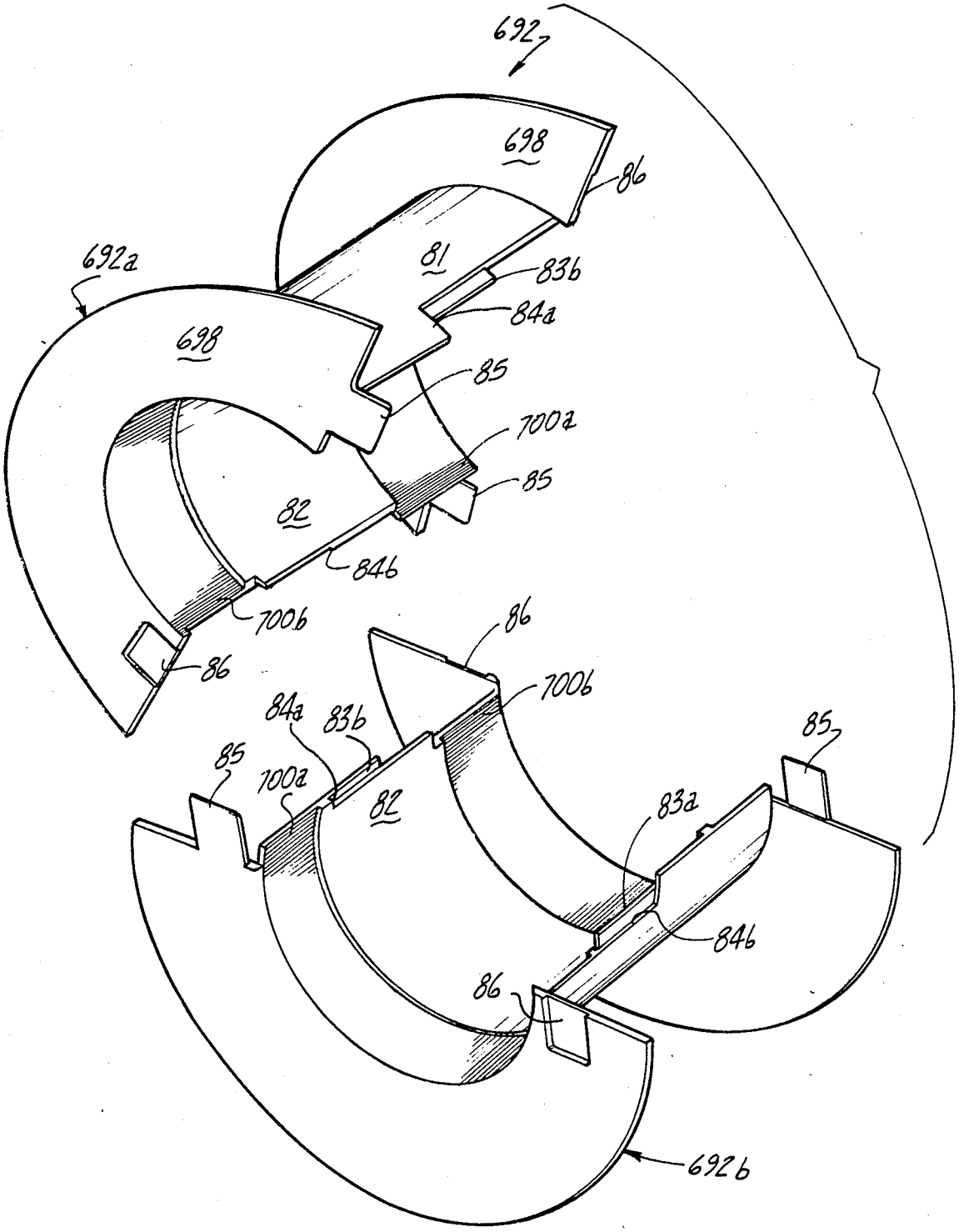
FIG. 6 is an exploded perspective view of a core wind-in bobbin of the present invention.

In FIG. 6, a detailed view of the bobbin 692 is provided. The bobbin 692 is utilized to facilitate the installation of the magnetic core 20 of the toroidal transformer. The bobbin 692 generally comprises a central cylindrical hollow hub 81 which joins two radial flanges 698. The bobbin is adapted so that the strip of core material can be wound upon the hub 81 and constrained between the radial flanges 698. The interior of the hollow hub 81 has a pair of axially-spaced, circumferentially-extending gear drive surfaces 700 provided with axially disposed gear teeth used for rotatably driving the bobbin 682. A bearing surface 82 is located between the gear drive surfaces 700 and projects radially inward beyond the gear teeth of gear drive surfaces 700A and 700B. When installed, the bearing surface 82 will contact the coil insulation material 30 prior to any contact by the gear teeth to prevent that material from being abraded or otherwise damaged by the gear teeth during rotation of the bobbin 692.

The bobbin 692 consists of a pair of identical halves 692A and 692B which are adapted to mate to form the complete bobbin 692 after assembly of each of the bobbin halves into respective half sections 11 and 12 of the transformer. The bobbin halves 692A and 692B are especially configured to permit efficient operation of the assembled bobbin 692. Particularly, the bobbin halves 692A and 692B are provided with an axial lock at each joint of the bobbin half 692A and 692B. Each axial lock includes flanges **83*a* and 83*b* which are adapted to interlock with inset shoulders 84*a* and 84*b* upon mating of the bobbin halves 692A and 692B to prevent axial shifting of the bobbin halves. Each bobbin half 692A is provided with a pair of projecting tabs 85 and complementary recesses 86 which are designed to mate with corresponding recesses 86 and tabs 85 of the other bobbin half, with the tabs 85 wholly residing within their mated recesses 86. Preferably, the tabs 85 are glued or otherwise adhered to their mated recesses 86 to retain the bobbin halves 692A and 692B** in their interlocked state.

It should be noted that the gear surfaces 700A and 700B terminate at different circumferential positions. Consequently, when the bobbin 692 is driven by the pinion shaft drive gears, the pinion shaft drive gears transition between the bobbin halves one pinion gear at a time to reduce the drive forces tending to separate the bobbin halves 692A and 692B. In other words, the two pinion gears driving the bobbin 692 do not simultaneously switch between the gear teeth of one bobbin half to the gear teeth of the other bobbin half, but switch in staggered fashion so that any imperfection at the mating of the bobbin halves will be compensated by circumferential offset of the joints in the gear surfaces 700A and 700B.

As previously explained, the bobbin halves 692A and 692B are assembled with the pre-formed high and low voltage winding assemblies, including the insulating tubes 30 and 50 with cuffs 59, and are then joined to construct a complete bobbin 692 within the pre-formed windings and insulation whereby the core can thereafter be wound into the pre-formed windings onto the bobbin 692.

Figure 7:
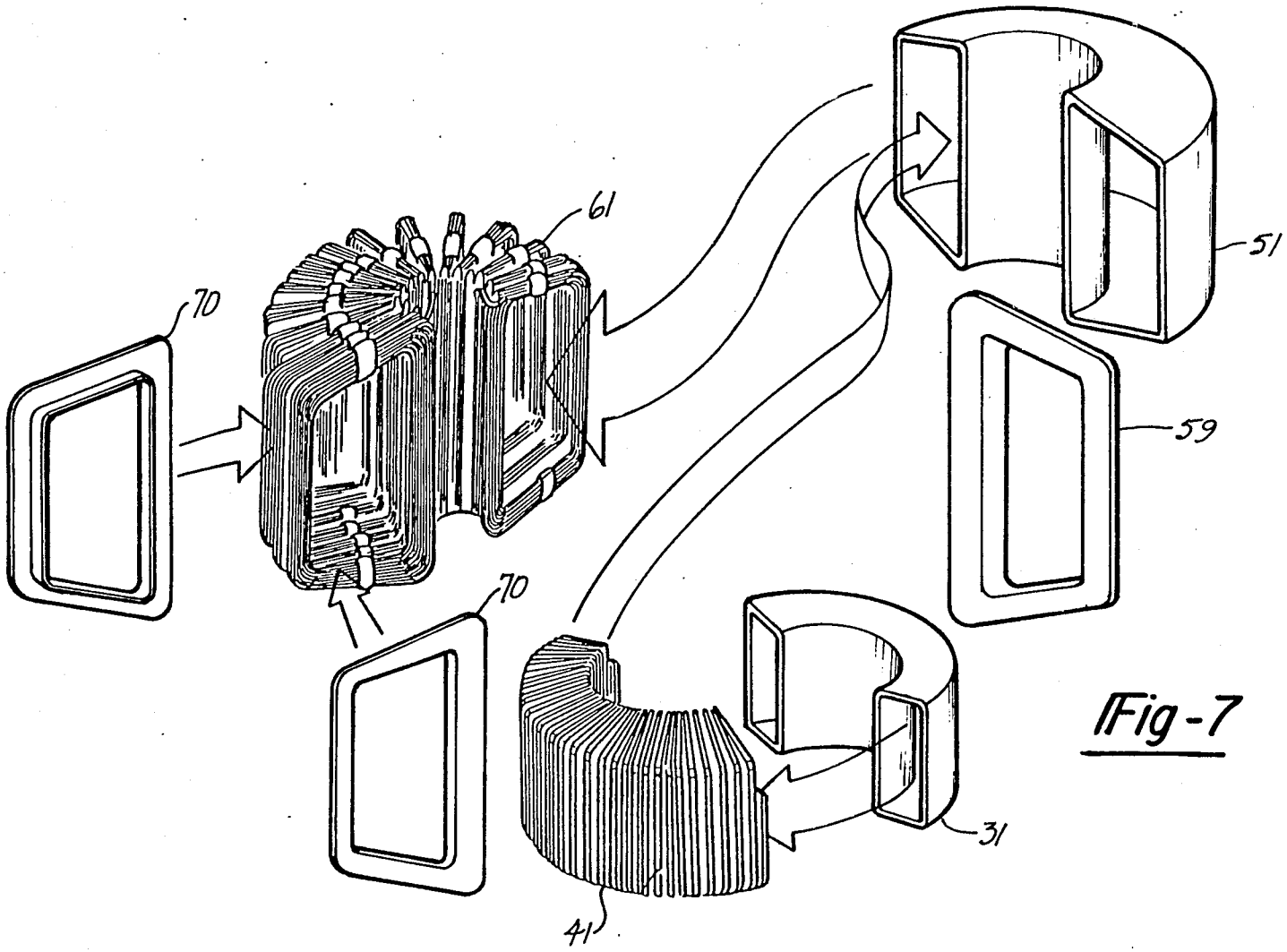
FIG. 7. is a schematic view illustrating the preferred assembly of the major transformer components prior to installation of the magnetic core.

As is shown schematically in FIG. 7, the semitoroidal transformer half-portions or sections 11 and 12 each extend circumferentially through an arc of approximately 165 degrees as described above. The preferred transformer portions 11 and 12, when combined, thus form a substantial portion of a torus made up of two symmetrical halves with a circumferential space of approximately 15 degrees therebetween on each side. One of the primary purposes for the above-described construction is to form an arcuate elongated passage for allowing the core 20 to be continuously wound in place in a toroidal or annular configuration as is illustrated in FIGS. 1 through 3 and described in detail below. Once the core wind-in operation is completed, the transformer assembly is retained in its proper configuration by means of supporting blocks 80 (see FIG. 1), which maintain an equal spacing between the half-portions 11 and 12 on both sides of the transformer 10. The transformer assembly is then installed in a suitable containment structure such as the tank or housing 85 shown in FIG. 1. Various additional features will become readily apparent from the following description of the methods employed in the manufacture of a toroidal electrical transformer and the components thereof according to the present invention.

Figure 8:
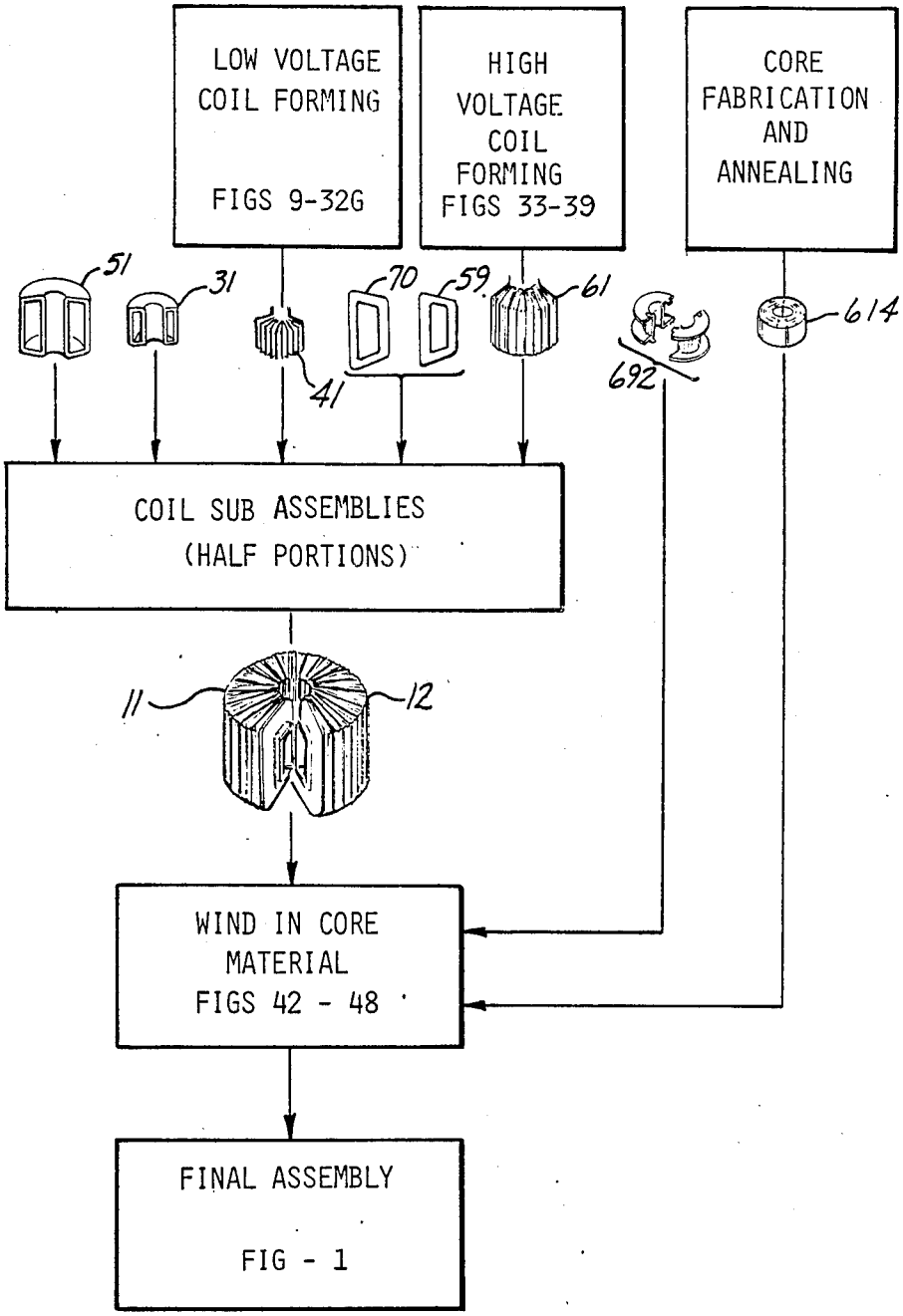
FIG. 8 is a block diagram, generally illustrating the preferred method of manufacturing a toroidal electrical transformer according to the present invention.

FIG. 8 illustrates, in block diagram form, an overview of the major operations involved in the preferred method of manufacturing the toroidal electrical transformer 10. Although for purposes of illustration, the reference numerals in FIG. 8 and in the following discussion relate to the transformer half-portion 11, the structure and production methods of the transformer half-portion 12 are preferably identical to those of the transformer half-portion 11.

The low voltage coil section 41 is preferably wound from bifilar conductor stock with each turn being formed into a pie or wedge shape (as viewed from above or below) to provide the toroidal or annular configuration. The above low voltage coil producing steps are described in detail below in connection with FIGS. 9 through 32 of the drawings.

The low voltage coil 41 is then positioned onto the exterior of the core insulation barrier 31 and encased within the high/low insulation barrier section 51 as is shown schematically in FIG. 7. The sub-assembly is then ready for addition of the high voltage coil section 61.

The high voltage coil section 61 is preferably wound from a continuous wire and formed into a number of pie or wedge shaped bundles or coils. These winding operations are described in detail below in connection with FIGS. 9 through 17.

As is illustrated schematically in FIG. 7, the insulating inserts 70 are located between adjacent coils of the high voltage coil section 61 with the cuffs 71 extending into the toroidal openings in the segments. The high voltage coil section 61 and the inserts 70 are then positioned onto the exterior of the high/low insulation barrier section 51 and the bobbin 692 is installed in the arcuate passage within the core insulation barrier 31. Thereafter, the end cuffs 59 are installed on the ends of the barrier tube 51, as illustrated in FIG. 5 to complete the operation of forming the half-portion 11 prior to the winding in of the core 20.

The core material, which is of a relatively thin, ribbon-like or strip configuration is preferably pre-wound into a tight coil and automatically severed at a prescribed length determined by the size of the transformer being produced. The coil is then preferably restrained and annealed to relieve its internal stresses. The resultant structure is a pre-wound, toroidal coil 614 which is ready for winding into the above-described transformer half-portions 11 and 12.

The remaining steps in the production process include the winding of the pre-formed, pre-annealed coil 614 into the bobbin 692 within the arcuate elongated passage through a circumferentially extending gap between the semi-toroidal sections 11 and 12, and the finishing assembly steps of installing the supporting blocks 80, electrically connecting the respective sections of low voltage coil 40 and the high voltage coil 60, and mounting the assembly in a suitable housing structure 85 (see FIG. 1).

Description of the High Voltage Coil Winding Machine

Figure 9:
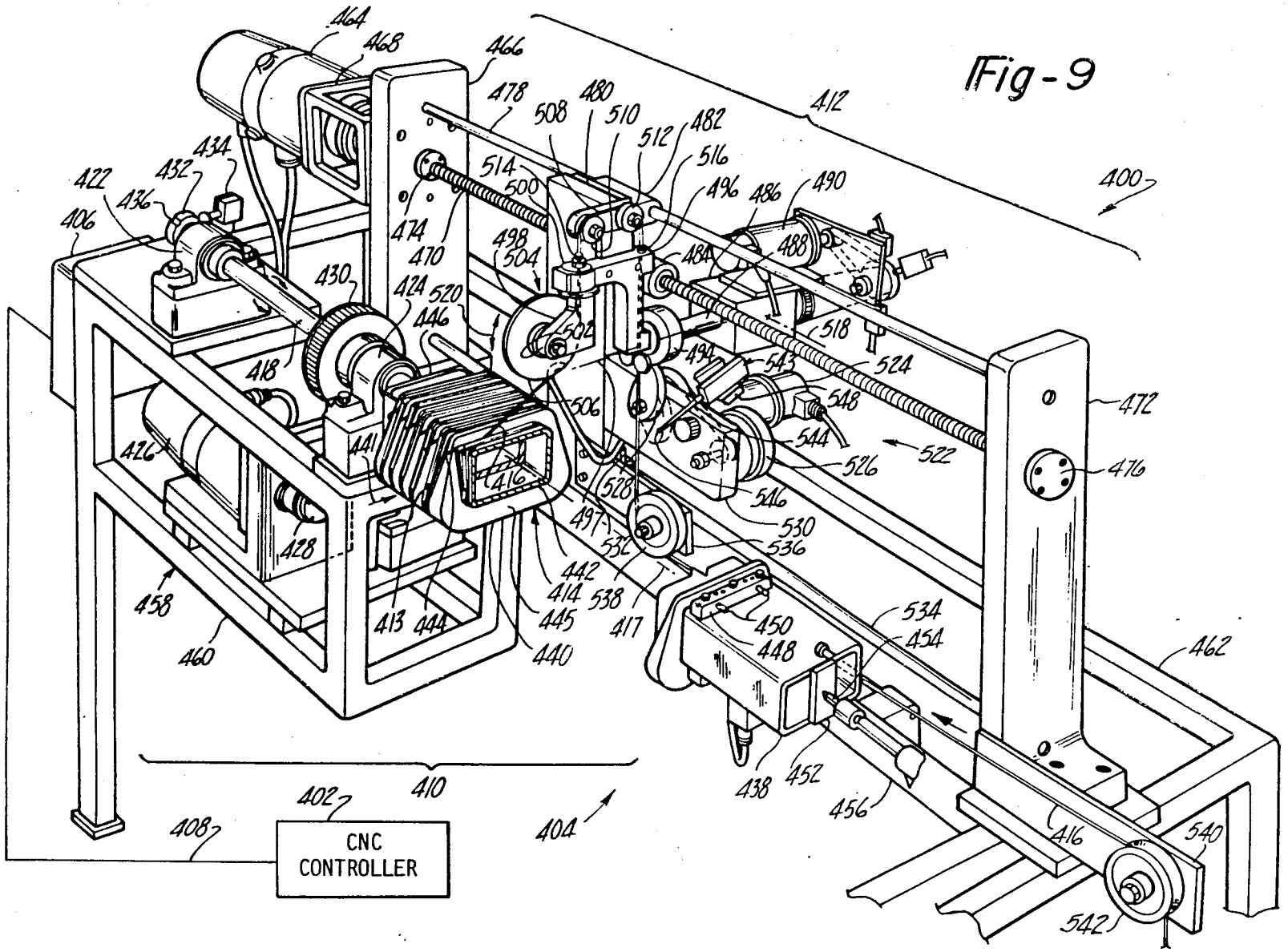
FIG. 9 is an overall view of a preferred high voltage coil winding machine used in connection with the present invention.
Figure 9A:
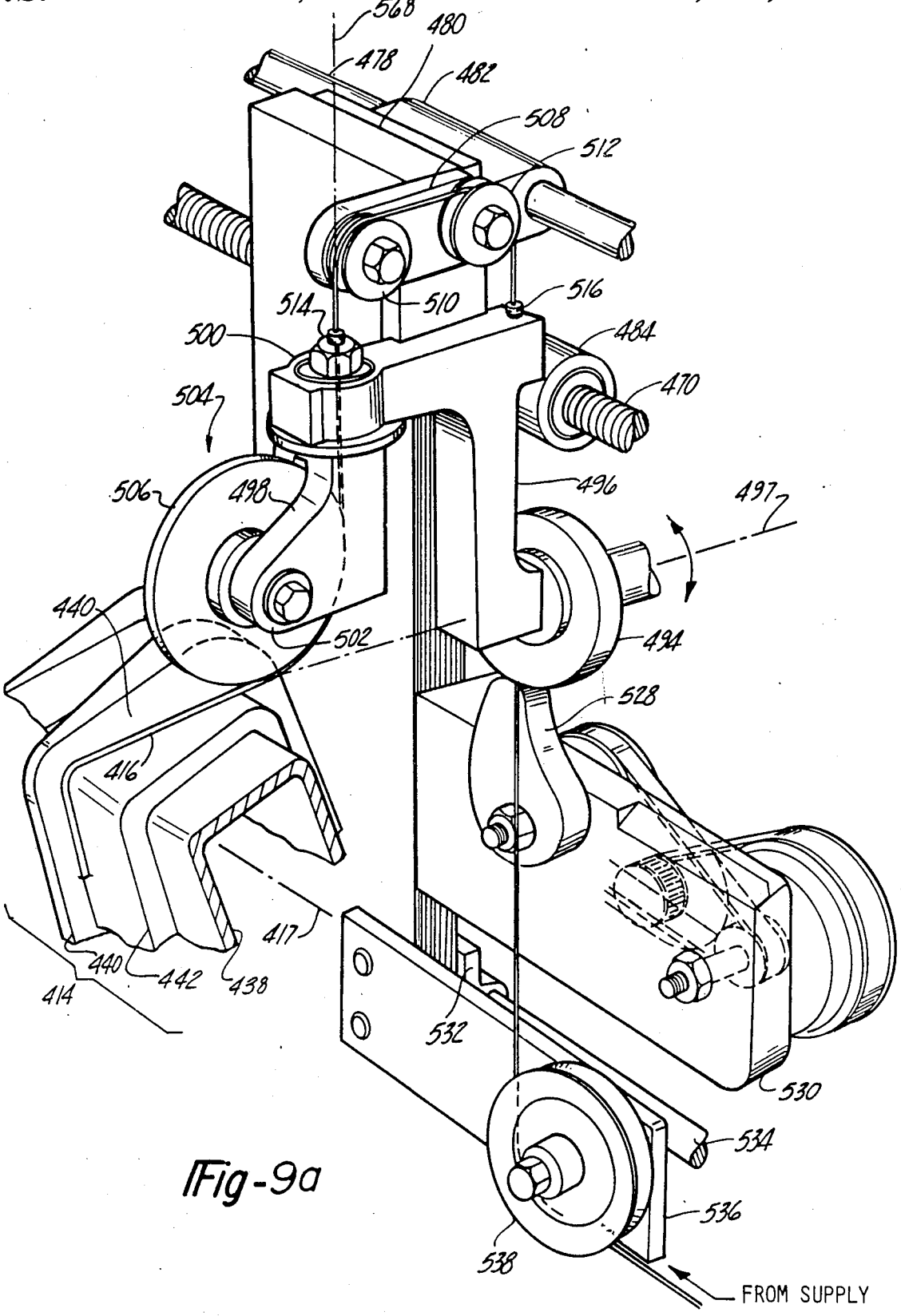
FIG. 9*a* is a detail view of a portion of a wire placement subassembly of the high voltage coil winding machine of FIG. 9.

In FIG. 9, a first embodiment of the high voltage coil winding machine 400 is seen to comprise a computer numeric controller 402 and a winding machine 404. The controller 402, for example, may be a numeric controller model Mark Century 2000 MC CNC produced by General Electric Co. Cincinnati, Ohio. The controller 402 is connected to a control cable connector box 406 on the winding machine 404 by a control cable 408. The controller 402 sends signals over the cable 408 which are effective to control the multiple functions of the winding machine 404 which will be described below. The winding machine 404 consists essentially of two subsystems, a rotatable mandrel subsystem 410 and a wire placement subsystem 412. As the mandrel rotates, the wire placement subsystem accurately positions a wire relative to the mandrel to cause the wire to be wound about the mandrel in a predetermined fashion to fabricate a plurality of integrally-connected high voltage bundles or coils 413. In plan view (FIG. 2), the coils 413 are seen as pie or wedge shaped, while in side view (FIG. 3) the coils are seen to have a generally quadrilateral section. The rotatable mandrel subsystem 410 includes a mandrel assembly 414 which is designed to rotate about a mandrel axis 417 causing wire 416 to be wound upon it in such predetermined fashion to provide the integrally connected, pie-shaped high voltage coils 413.

The mandrel assembly 414 provides a winding mandrel that is rotated about the mandrel axis 417 by a mandrel shaft 418 which engages the mandrel assembly 414 at a mandrel drive socket (not shown) which provides driving engagement between the mandrel shaft 418 and the mandrel assembly 414. The mandrel shaft 418 is rotatably mounted by means of a left mandrel shaft bearing 422 and a right mandrel shaft bearing 424. The mandrel shaft 418 is rotatably driven by mandrel servo motor 426 which is connected to drive the mandrel shaft 418 by means of a mandrel reduction drive 428 and a mandrel shaft drive pulley 430. The mandrel shaft 418 carries for rotation therewith a mandrel positioning cam 432 at its left extremity which is cooperatively engaged by a roller follower of a mandrel position switch 434. The mandrel position cam has a detent 436 which receives the roller of the mandrel positioning switch 434 to designate a measurement position for the mandrel assembly 414 for measuring the rotary position of the mandrel assembly 414 as will be explained below.

The mandrel assembly 414 includes a rectangular mandrel tube 438 which serves as the central support member for the mandrel assembly 414. Coil side forms 440 are wedge shaped plates, each having a rectangular opening for receiving the mandrel tube 438, and are installed on the mandrel tube 438 in a radial orientation with respect to the mandrel axis 417. The coil side forms 440 are wedge or pie-shaped when viewed from the top or bottom of the high voltage winding 413 (along the direction indicated by arrow 441). It should be noted that each coil side form 440 includes a wire crossover guide pin 444 fixed at its periphery near the transition between the top and the outside of the high voltage coils. Coil inside forms 442, which have a like rectangular opening, are interposed between the coil side forms 440 and serve to evenly space the coil side forms 440 on the mandrel tube 438. Note that the coil inside forms 442 are pie-shaped to correspond in reverse to the pie-shape of the coil side forms 440. The pie shapes of the coil side forms 440 and the coil inside forms 442 are dictated by the desired pie-shape of the high voltage coils 413. As shown in FIG. 2, the pie-shaped high voltage coils 413 are narrow at a radially inward portion 443 thereof. To form the radially inward portion 443 of the pie-shaped high voltage coils 113, the coil inside forms 442 have a corresponding lesser axial thickness and the coil side forms 440 have a corresponding greater axial thickness at the inside 445 of the pie section. The coil inside forms 442 also have a greater height from top to bottom at the inside 445 of the pie section so that its shape corresponds generally to the trapezoidal shape of the low voltage conductor with the insulated barrier 50 added thereto. The coil side forms 440 have a greater radial depth at the inside 445 of the pie section to accommodate a greater radial depth of the coil 413 at its axially narrowest point. When installed on the ( mandrel tube 438, each coil inside form 442 and its two adjacent coil side forms 440 form an annular wire cavity for containing multiple turns of the wire 416.

To assemble the mandrel assembly 414, alternating coil side forms 440 and coil inside forms 442 are slid over the mandrel tube 438 until they abut a left coil forms clamp 446. Once the coil side forms 440 and coil inside forms 442 are positioned in abutting relationship on the mandrel tube 438, the right coil forms clamp 448 is secured to the mandrel tube 438 and clamping screws 450 are turned to clamp the coil side forms 440 and coil inside forms 442 into position as shown in FIG. 9. Note that a portion of the mandrel assembly 414 is cut away in FIG. 9 for clarity.

As previously stated, the mandrel assembly 414 is rotatably driven by the mandrel drive socket which is mounted on a bracket on the left end of the mandrel tube 438. The mandrel assembly 414 is supported on its right end by a mandrel support bracket 452 which is secured to the right end of the mandrel tube 438. The mandrel support bracket 452 has a central depression which receives the pivot member 454 of a mandrel tail stock assembly 456. The mandrel subsystem 410 is mounted on a support frame assembly 458 which includes a rectangular, forwardly-projecting section 460 for supporting the mandrel servo motor 426, and the mandrel shaft bearings 422 and 424. The support frame assembly 458 also has a main section 462 which supports the wire positioning subsystem 412 and the mandrel tail stock assembly 456.

The wire placement subsystem 412 includes a traverse servo motor 464 which is mounted on a left traverse upright 466 by a traverse motor mount 468. The traverse servo motor 464 drives a traverse drive screw 470 of predetermined thread pitch which extends between the left traverse upright 466 and the right traverse upright 472. The traverse drive screw is supported by a left traverse drive screw bearing 474 and a right traverse drive screw bearing (not shown). An upper traverse guide rod 478 is positioned above and parallel to the traverse drive screw 470 and extends between the left traverse upright 466 and the right traverse upright 472.

A traverse frame 480 is slidably mounted on the upper traverse guide rod 478 by an upper slide bearing 482. The traverse frame 480 also carries a traverse drive ball nut 484 which is threaded on the traverse drive screw 470 so that rotation of the drive screw 470 by the traverse servo motor 464 causes the traverse drive ball nut 484 to be driven to the left or right, depending upon the direction of rotation of the traverse drive screw 470, and causing the traverse frame 480 to be moved to the left or right correspondingly. Note that the lower end of the traverse frame 480 has a lower slide bearing 532 which receives a traverse guide rod 534 for supporting and guiding the lower end of the traverse frame 480. The lower traverse guide rod 534 is supported by the left traverse upright 466 and the right traverse upright 472 as shown and is disposed parallel to the traverse drive screw 470 and the upper traverse guide rod 478.

Traverse frame 480 carries a tilt axis bearing box 486 which in turn rotatably carries a tilt axis shaft 488. The tilt axis shaft 488 is rotatably driven by a tilt servo motor 490. The tilt axis shaft 488 carries a lift cam follower 494 which is rotatably mounted relative to the tilt axis shaft 488 by means of a suitable bearing. The tilt axis shaft 488 also carries a caster arm 496 which is rigidly mounted to the tilt axis shaft 488 for rotation therewith about a tilt axis 497 as illustrated.

As best shown in FIG. *9a*, the caster arm 496 carries a wire placement wheel yoke 498 which is rotatably mounted on the caster arm 496 by a caster bearing 500. The wire placement wheel yoke 498 is rotatable about a caster axis 568 through the center of the caster bearing 500 that is transverse to the tilt axis 497 and to the mandrel axis 417. The wire placement wheel yoke 498 is bifurcated to provide a pair of support arms 502 which receive the mounting shaft of a wire placement wheel 504. The wire placement wheel 504 is mounted on bearings for rotation relative to the wire placement wheel yoke 498 about an axis that is transverse to both the caster axis 568 and the tilt axis 497. The wire placement wheel 504 has a groove 506 in its periphery for receiving and guiding the wire 416 and provides means for placing the wire 416 within the annular wire cavities. The caster arm 496 also carries a wire guide bracket 508 having a front wire guide pulley 510 and a rear wire guide pulley 512. The front wire guide pulley 510 and the rear wire guide pulley 512 are each rotatably mounted on the wire guide bracket 508 and each has a groove in its periphery for receiving and guiding the wire 416. The wire guide bracket 508 is mounted to pivot clockwise about the axis of rear pulley 512. The wire guide pulley 508 is biased upwardly by a suitable spring (not shown) to bias front pulley 510 upwardly to tension the wire 416. Caster arm 496 also includes a forward fixed wire guide 514 and a rearward fixed wire guide 516. The rearward fixed wire guide 516 guides the wire 416 from below the caster arm 496 to the rear wire guide pulley 512. The wire 416 thereafter passes over the rear wire guide pulley 512 and extends forwardly to the front wire guide pulley 510. After traversing the wire guide pulley 510, the wire 416 extends downwardly through the forward fixed wire guide 514 to the groove 506 in the periphery of wire guide wheel 504 for accurate placement on the mandrel assembly 414 as will be explained in detail in connection with FIGS. 11 through 14.

The lower portion of the traverse frame 480 also carries a lower guide pulley bracket 536 which carries a lower wire guide pulley 538. A wire tensioning pulley bracket 540 is mounted on the right traverse upright 472 and carries a wire tensioning pulley 542. The wire 416 is guided into the wire placement subsystem 412 by the wire tensioning pulley 542 and the lower wire guide pulley 538. Wire 416 is directed from the lower wire guide pulley 538 upward through the rearward fixed wire guide 516, and hence to the wire placement wheel 504 as previously described. The wire tensioning pulley 542 is spring-loaded to maintain a suitable tension on the wire 416 as the wire is wound onto the mandrel assembly 414.

As previously indicated, the tilt axis bearing box 486 is carried by the traverse frame 480. However, it is not rigidly mounted to the traverse frame 480. Rather, it is mounted by a suitable bearing shaft (not shown) for rotation about a Z-axis pivot 518 (FIG. 9). Pivoting of the tilt axis bearing box 486 about the Z-axis pivot 518 causes corresponding tilting of the tilt axis shaft 488 and corresponding upward and downward movement of the wire placement wheel 504 in the direction of arrows 520.

Pivoting of the tilt axis bearing box 486 and corresponding upward and downward movement of the wire placement wheel 504 is provided by a lift cam subassembly 522. As shown in FIG. 9, the lift cam subassembly 522 includes a lift cam servo motor 524 which drives a lift cam reduction drive 526 to, in turn, rotatably drive a lift cam 528. The lift cam 528 engages the lift cam follower 494 to cause upward and downward movement of the lift cam follower 494 and corresponding pivoting of the tilt axis bearing box 486 in accordance with the profile of the lift cam 528 as the lift cam 528 rotates under control of the lift cam servo motor 524. Note that in FIG. 9 the tilt axis bearing box 486 and attached wire placement wheel 504 are pivoted upward for clarity. The lift cam subassembly 522 is mounted on a lift cam bracket 530 which is securely mounted on the traverse frame 480 for leftward and rightward movement with the traverse frame 480 under control of the traverse servo motor 464 and the controller 402.

The lift cam bracket 530 also carries a mandrel position measuring device 543 (see FIG. 10*a*) which includes a probe 544 and a probe transducer 546. The probe transducer 546 is slidably mounted on a support 548 which in turn is mounted on the lift cam bracket 530. The probe transducer 546 can be extended from and retracted toward the support 548 by a suitable air cylinder arrangement (not shown). The mandrel position measuring device 543 is connected to the computer numeric controller 402 and is used to measure the axial position of one edge of each coil inside form 440 of the mandrel assembly 414 and to provide that position information to the computer numeric controller 402 so that it may in turn accurately position the wire placement wheel 504 between the coil side forms 440 for winding the coils.

It should be noted that the traverse servo motor 464, the mandrel servo motor 426, the tilt servo motor 490, and the lift cam servo motor 524 are all highly accurate devices which operate in response to control signals sent by the computer numeric controller 402. The computer numeric controller 402 causes each of the servo motors to operate cooperatively to perform the functions hereinafter described.

In the operation of the high voltage coil winding machine 400, an empty mandrel assembly 414 is mounted on the mandrel subsystem 410 between the mandrel drive socket and the mandrel tail stock assembly 456. Since, in a production environment, each high voltage coil winding machine will be operated with several mandrel assemblies 414 used sequentially, and since it must be expected that the component parts of each mandrel assembly 414 used with the coil winding machine 400 will have somewhat different dimensions due to normal manufacturing tolerances, the total accumulated tolerance of the stack of coil side forms 440 and coil inside forms 442 is expected to vary considerably over the length of the mandrel assembly 414. Therefore, to facilitate accurate positioning of the wire 416 within each annular wire cavity it is necessary to measure the position of each coil side form 440 in the mandrel assembly 414. This measurement is accomplished by the mandrel position measuring device 543 and is more particularly described with respect to FIGS. 10 and 10*a*.

To facilitate measurement of the mandrel assembly 414, the mandrel shaft 418 is rotated to an initial position in which the roller of the mandrel positioning switch 434 resides in the detent 436 of the mandrel positioning cam 432. In that position, the mandrel assembly 414 is positioned substantially as illustrated in dashed lines at position 550 in FIG. 10. With the mandrel 414 at position 550, the probe transducer 546 is moved forwardly into its extended position 552. Note that when the mandrel assembly 414 is at position 550, there is clearance between the mandrel assembly 414 and the probe transducer 546 to permit the transverse servo motor 464 to move the traverse frame 480 and attached mandrel position measuring device 543 with respect to the mandrel assembly 414.

Figure 10A:
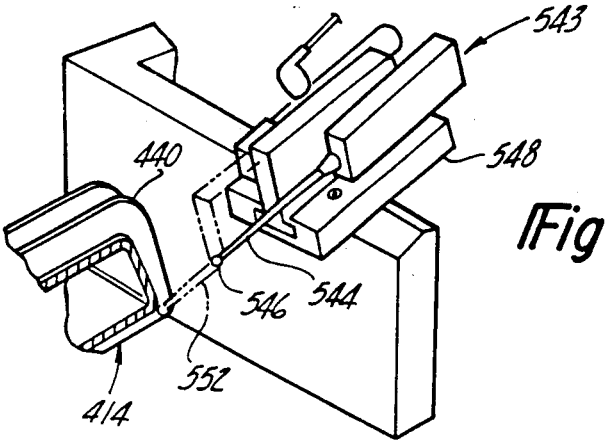
FIG. 10*a* is a perspective view of the mandrel and mandrel position measuring device of FIG. 10.
Figure 10:
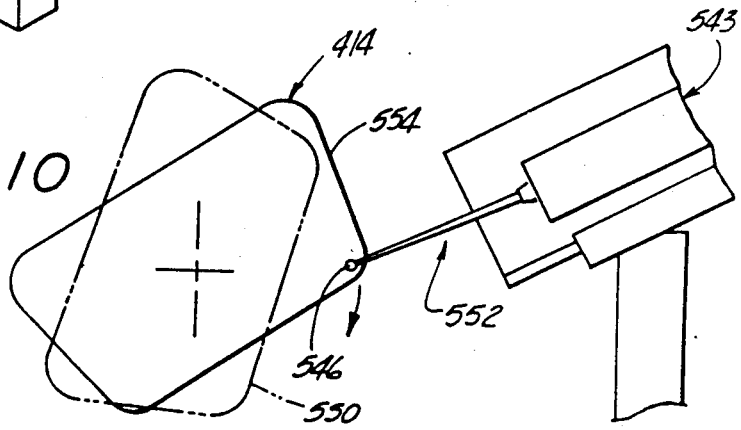
FIG. 10 is a side elevation detail view of a mandrel and mandrel position measuring device of the high voltage coil winding machine of FIG. 9.

To begin the axial measurement of the annular wire cavities of the mandrel assembly 414, the mandrel position measuring device 543 is moved to a position adjacent the first wire cavity by rotation of the traverse servo motor 464. During that movement, the mandrel assembly 414 is in position 550 to provide clearance for the probe transducer 546. Once the probe transducer 546 is in the appropriate position, the mandrel assembly 414 is rotated approximately 90° to a measurement position 554 to present the face or side wall of the coil side form 440 adjacent its radially-outside corner, to the probe transducer 546 as illustrated in FIGS. 10 and 10*a*. With the mandrel assembly 414 in the measurement position 554, the position of that face can be determined with accuracy by the mandrel position measuring device 543 by further rotation of the traverse servo motor 464 until the probe transducer 546 senses the coil side form 440 that forms the side wall of the wire cavity. Preferably, the probe transducer 546 is a contact sensor which senses the coil side form 440 by contact. The axial measurement of the wire cavity equals the position of the traverse servo motor 464 when the probe transducer 546 senses the coil side form 440. That measurement is remembered by the computer numeric controller 402. After that measurement is taken, the mandrel assembly 414 again rotates to the probe-clearance position 550, the mandrel position measuring device 543 is traversed by rotation of the traverse servo motor 464 to a position adjacent to the next wire cavity, and then the mandrel assembly 414 is again rotated to the measuring position 554. Thereupon, a measurement is taken of the corresponding side surface of the second wire cavity, and that measurement is stored in the computer numeric controller 402. This measuring-traversingmeasuring operation is repeated for each wire cavity until the corresponding surface of each wire cavity of the entire mandrel assembly 414 is taken and recorded in the computer numeric controller. Those measurements are thereafter used to control the rotation of the traverse servo motor 464 to position the wire placement wheel 504 accurately with respect to each of the wire cavities during the coil winding operation.

Figure 15:
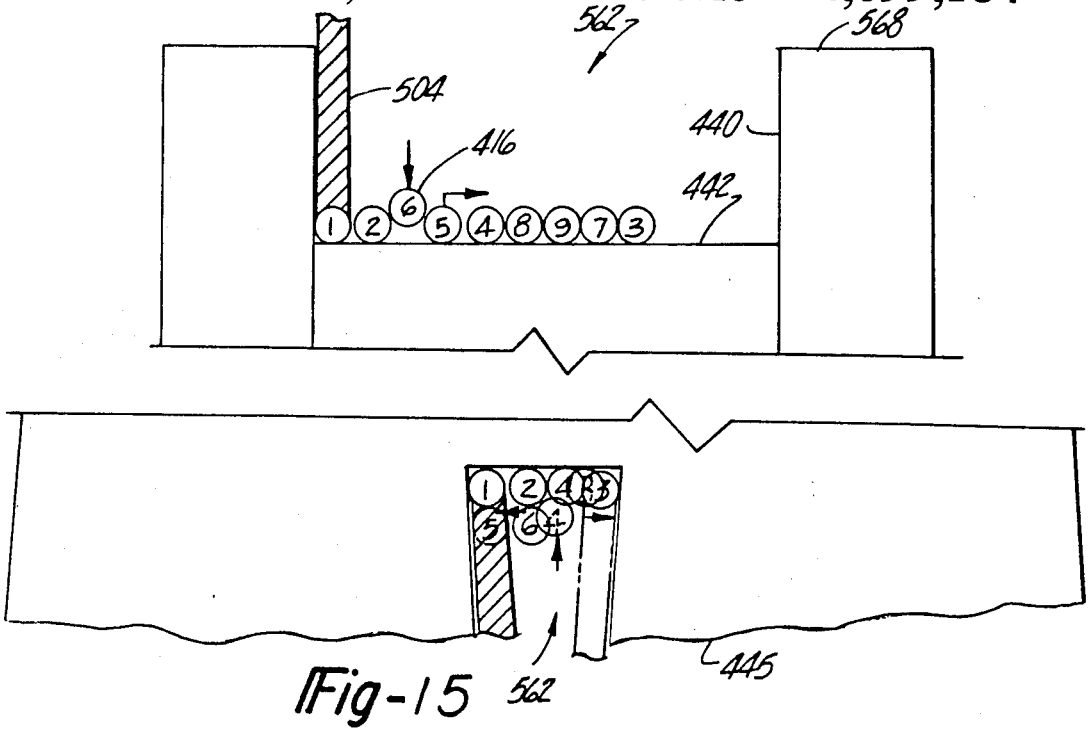
FIG. 15 is a sectional detail view of the mandrel at a still later stage in the winding of a high voltage coil.
Figure 11:
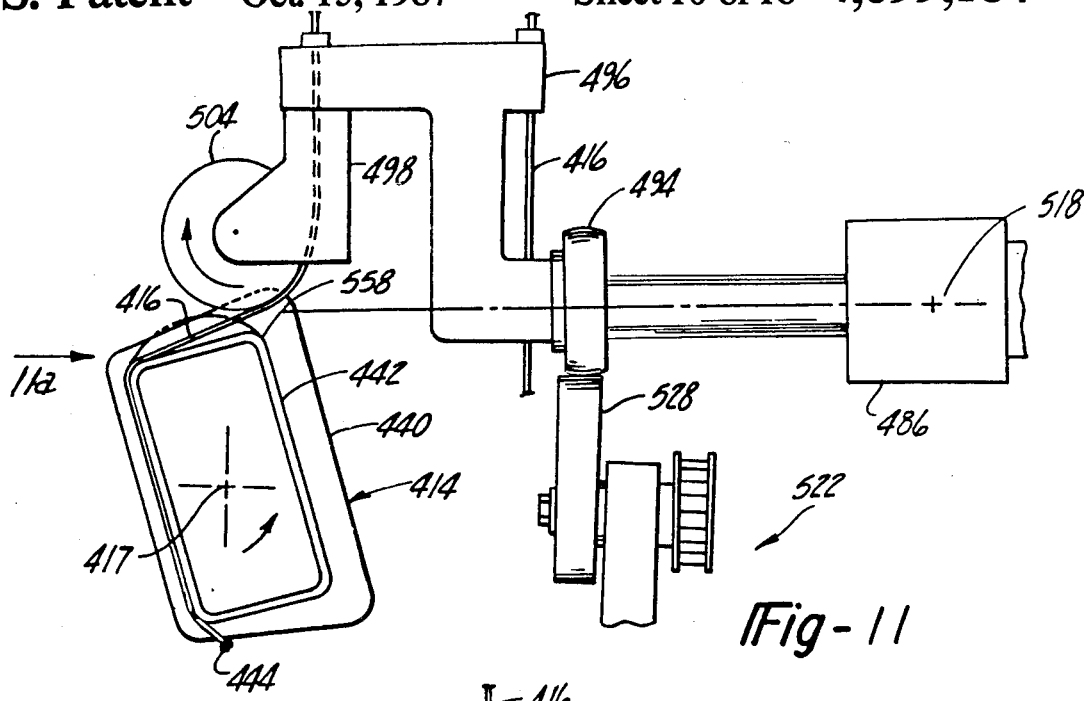
FIGS. 11 through 14 are a series of sequential views of the mandrel and wire placement subassembly of the high voltage coil winding machine of FIG. 9.
Figure 11A:
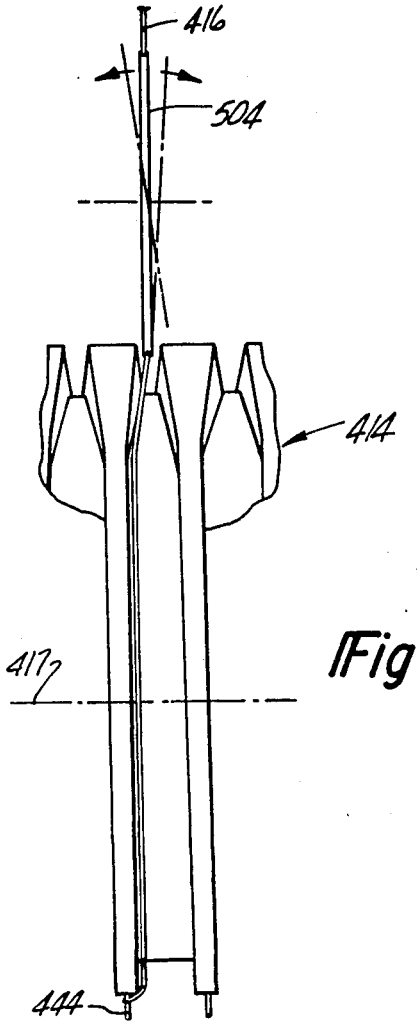
FIG. 11*a* is a front elevation view of the mandrel and is viewed along arrow 11*a* of FIG. 11.

The manner in which the conductive wire is laid into the annular wire cavity defined by the coil side forms 440 and coil inside form 442 during winding is illustrated in FIGS. 11 through 14. As described above, the wire placement wheel 504 acts as a positioning guide to place the wire 416 within the wire cavities. In FIGS. 11 and 11*a*, the wire placement wheel 504 is illustrated at the upper inside corner of the winding mandrel assembly 414 for one of the wire cavities. Note that the wire 416 is held in place on the outside portion of the cavity by virtue of the wire crossover guide pin 444. Note also that the wire placement wheel 504 is lifted above the bottom surface of the wire cavity by the lift cam 528 in addition to the amount necessary to clear the bottom surface corner 558 of the mandrel assembly 414 as the mandrel assembly 414 rotates in a counterclockwise direction. An additional amount of lift is required in order to allow placement of the wire 416 in predetermined positions which vary as between the inside leg and the outside leg of the toroidal high voltage winding, for example, as illustrated in FIG. 15. Particularly, without the additional lift of the wire placement wheel 504, the wire 416 will tend to guide along the previously laid turn since it is being pulled along the side of the previously-laid turn because of the winding tension in wire 416. Consequently, this guiding effect must be overcome to allow the new turn to cross over the previously-laid turn as required by the predetermined coil placement patterns of the inside and outside legs, for example, as illustrated in FIG. 15. Without the additional lift, the maximum lateral force which can be applied to the wire by the wire placement wheel 504 is insufficient to accomplish the cross over of the previously laid turn. The maximum lateral force which the wire placement wheel 504 can apply to the wire 416 is a function of the depth of the groove 506 and the winding tension. If it is exceeded, the wire 416 will slip off the wire placement wheel 504 preventing further accurate placement of the wire 416 until it is re-mounted on the wire placement wheel 504. Consequently, when the additional lift is not employed, the wire 416 tends to slip off the wire placement wheel 504 as a result of the guiding force caused by the previously-laid turn. The additional lift, as illustrated in the FIGS. 11–15, reduces the guiding force of the previously laid turn to keep it within the maximum lateral force capability of the wire placement wheel 504. It should be noted that to achieve volumetric efficiency, all cross overs of wire 416 occurs on the top or bottom legs of the toroidal high voltage coils. As illustrated in FIG. ll*a* at the rotational position of the mandrel assembly 414 illustrated in FIG. 11, the wire placement wheel 404 is oriented perpendicularly to the mandrel axis 417.

Figure 12:
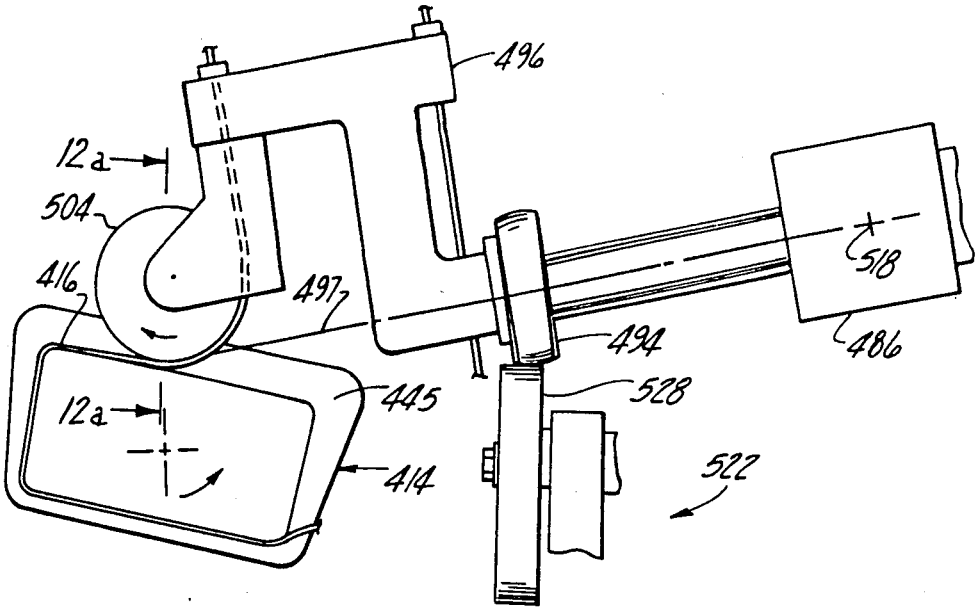
Figure 12A:
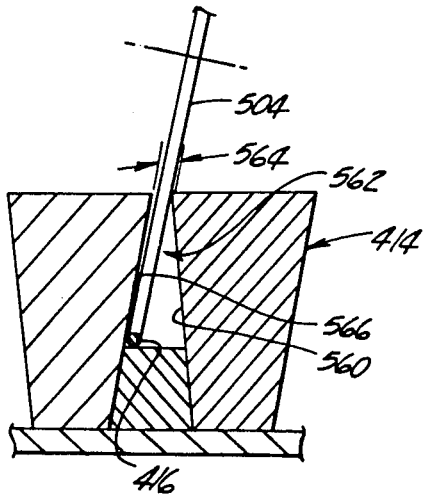
FIG. 12*a* is a sectional detail view of the mandrel and is viewed along line 12*a*–12*a* of FIG. 12.

In FIGS. 12 and 12*a*, the mandrel assembly 414 is seen rotated counterclockwise to a position in which the wire placement wheel 504 is located near the midpoint of the inside leg of the wire cavity. The axial cross-section of the cavity at the inside leg is trapezoidal as illustrated in FIG. 12*a*, in other words, the side walls 560 and 566 of the annular wire cavity 562 converge toward the entrance 564 to the wire cavity. To accommodate this trapezoidal cross-section, but yet place the wire at positions within the wire cavity which are laterally outside of the narrow entrance 564 to the wire cavity, the wire placement wheel 504 is tilted about the tilt axis 497 by rotation of the tilt servo motor 490. Note that the tilt axis 497 is tangent to the lower edge of the wire placement wheel 504 where the wire exits the groove 506 of the wire placement wheel 504, which allows the caster arm 496 to be tilted without changing the axial position of the wire 416. The axial position of the wire 416 within the wire cavity 562 is determined by the position of the traverse frame 480, and is controlled by the traverse servo motor 464. Additionally, to place the wire 416 in the bottom of the wire cavity, the caster arm 496 and the tilt axis bearing box 486 are pivoted about the Z-axis 518 upon rotation of the lift cam 528 to lower the wire placement wheel 504 into the wire cavity 562 to place the wire 416 in the proximity of the bottom of the wire cavity. Note that, since the wire tensioning pulley 542 maintains tension on the wire 416 as the mandrel rotates, the wire conforms to the shape of the periphery of the wire placement wheel 504. In other words, the wire placement wheel 504 imposes a prebend on the wire 416 that is opposite the bend imposed on the wire 416 as it is wound into the wire cavity 562. This prebend reduces the tendency of the wire to bow away from the bottom surface of the wire cavity 562. Also note that, at the inside leg 445 of the wire cavity 562, the opening 564 into the wire cavity is slightly wider than the thickness of the wire placement wheel 504.

Figure 13:
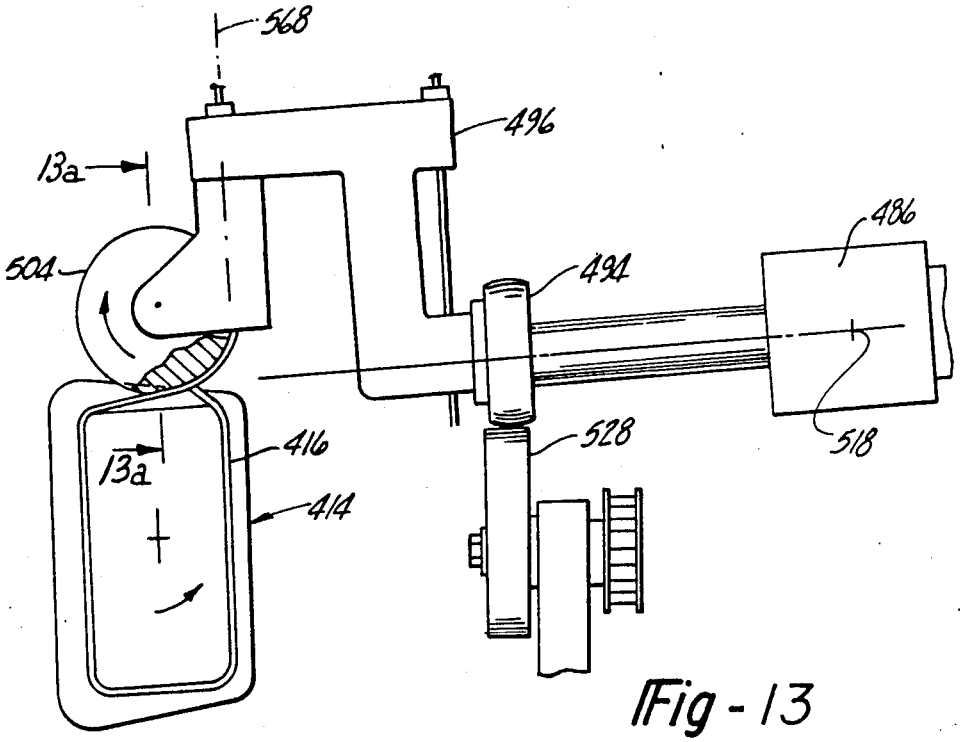
Figure 13A:
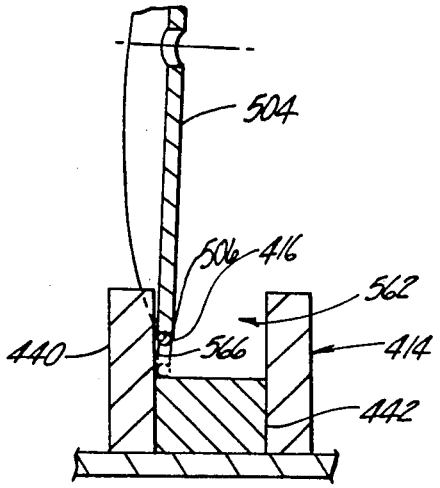
FIG. 13*a* is a sectional detail view of the mandrel and is viewed along line 13*a*–13*a* of FIG. 13.

In FIGS. 13 and 13*a*, the mandrel assembly 414 has further rotated counterclockwise to position the wire placement wheel 504 within the bottom leg of the wire cavity 562. Note that as shown in FIG. 13, the lift cam 528 has rotated to position the wire placement wheel 504 above the bottom of the wire cavity 562 to not only clear the corners of the bottom surface of the wire cavity, but an additional amount as previously explained. As illustrated in FIG. 13*a*, the wheel has tilted to a position near vertical. Additionally, the wire placement wheel 504 has castered by rotating about the caster axis 568 so that the lower part of the wheel lays along the skewed left side wall 566 of the coil side form 440 to place the wire 416 near the bottom corner of the wire cavity 562. But for this castering feature, the wire placement wheel 504 would be unable to follow the skewed side wall of the wire cavity. To place the wire 416 along the skewed side wall, in addition to the castering action, the traverse servo motor 464 drives the traverse frame 480 and the wire placement mechanism including the wire placement wheel 504. Note that castering in the opposite direction must occur to place the wire 416 at the lower right-hand corner of the wire cavity 562. Additionally, no castering is required for placement of the wire 416 in the center of the wire cavity since the wire placement wheel 504 need not place the wire along the skewed side walls.

The castering action of the wire placement wheel 504 is not separately driven. Rather, castering rotation is freely permitted and occurs by virtue of the drag or tension force of the wire 416 as it is being wound into the wire cavity. For example, when the traverse servo motor 464 rotates to move the traverse frame 480 and the wire placement mechanism including the wire placement wheel 504 to position the bottom periphery of the wire placement wheel 504 in position to locate the wire 416 at the left side wall 566 of the wire cavity 562 as illustrated in FIG. 13*a*, the wire placement wheel 504 rotates about the caster axis 568 by virtue of the wire 416 pulling the wheel 504 toward the left side wall of the wire cavity. In effect, the tension force on the wire 416 which is applied to the periphery of the wire placement wheel 504 at a point displaced from the caster axis causes alignment of the wire placement wheel 504 with the wire 416.

Figure 14:
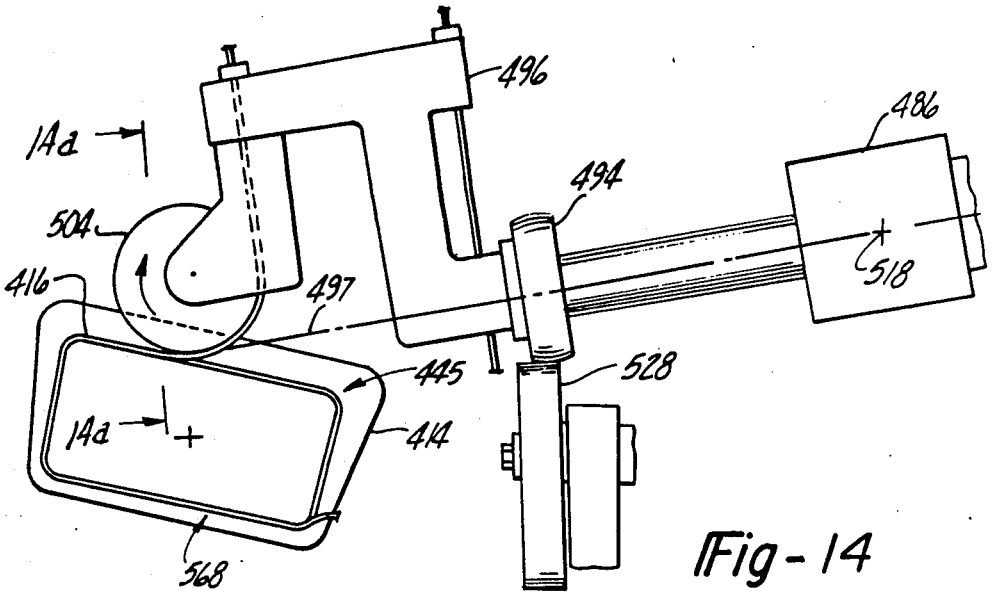
Figure 14A:
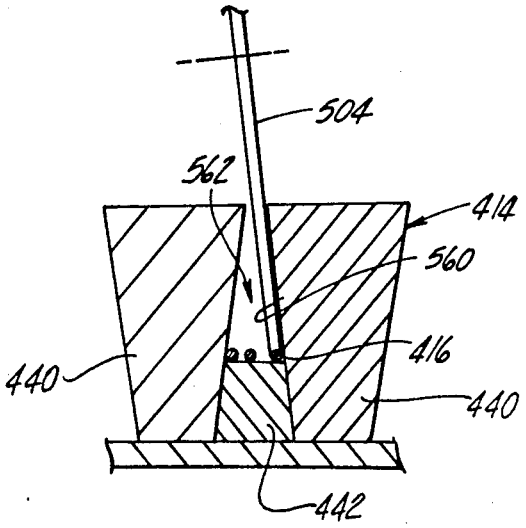
FIG. 14*a* is a sectional detail view of the mandrel and is viewed along line 14*a*–14*a* of FIG. 14.

In FIGS. 14 and 14*a*, the winding of the next full turn is illustrated. As shown in FIG. 14*a*, the wire 416 is placed at the bottom of the wire cavity 562 at the rightward side wall 560. To cause placement at the rightward side wall 560, the tilt servo motor 490 has rotated the caster arm 496 and the wire placement wheel 504 about the tilt axis 497 to position the bottom of the wire placement wheel 504 at the bottom right of the wire cavity 562, and the traverse servo motor 464 has moved the traverse frame 480 and attached wire placement wheel 504 to the right. Since the wire placement wheel 504 is now traversing the axially straight inward leg of the coil, it does not caster.

The winding process continues until the entirety of the bottom of the inward leg 445 of the wire cavity 562 is covered with a single layer of wire, for example, in a sequence as illustrated in FIG. 15. Note that the first turn is laid at the bottom left corner of the inside leg 445 of the wire cavity 562 and at the bottom left corner of the outside leg 568 of the wire cavity. The second turn is laid adjacent the first turn. Thereafter, the third turn is laid at the bottom right corner of the inside leg 445 of the wire cavity 562 while the third turn is laid approximately two-thirds of the distance across the outside leg 568 of the wire cavity from the first turn. Subsequently, the fourth turn is laid in between the second and third turns in the inside leg 445 of the wire cavity to wedge the second and third turns apart to tightly fill the bottom of the inside leg 445 of the wire cavity. Subsequent turns, i.e., turns 5, 6, et al., are laid on top of the first layer of the inside leg 445 of the wire cavity until the first layer of the outside leg 568 of the wire cavity 562 is filled. The first layer of the outside leg 568 of the wire cavity is tightened by a similar wedging placement of the last turn of the first layer of the outside leg. The winding build continues until the appropriate number of turns has been laid in a pie-shaped pattern as defined by the side walls of the coil side forms 440, thus forming a bundle or coil 413 of the high voltage winding 60.

After a complete coil 413 has been wound in the first wire cavity 562, the lift cam servo motor 524 lifts the wire placement wheel 504 from the wire cavity and the traverse frame 480 carrying the wire placement wheel 504 traverses to the next wire cavity under control of the traverse servo motor 464. That traverse occurs with the mandrel assembly 414 positioned so as to cause the wire 416 to loop around the wire crossover guide pin 444 as illustrated in FIG. 9. Thereafter, the next coil 413 is wound in the next wire cavity in the same fashion described above. It should be noted in this regard that accurate axial placement of the wire 416 within the wire cavities is accomplished by accurate axial positioning of the wire placement wheel 504 in accordance with the measured axial positions of the side walls of the coil side forms 440 which were stored in the computer numeric controller 402. Consequently, the computer numeric controller causes the traverse servo motor 464 to rotate in an amount in accordance with that measured dimension when the traverse frame 480 is moved from a position suitable for winding one coil to a position suitable for winding the next coil.

When all of the wire cavities of the mandrel assembly 414 have been wound to form the pie-shaped coils 413, the end of the wire 416 is cut and secured, and the mandrel assembly is removed from the high voltage coil winding machine 400. Thereafter, a new mandrel assembly is installed and measured to determine accurately the axial positions of the wire cavities 562. Thereafter, a new sequence of operations occurs to wind coils into each of the wire cavities as previously described.

After removal of the mandrel assembly 414, the coils of wire 416 are bonded together, for example by apparatus of heat to a thermo-bonding coating on the wire 416. This heat can be generated in an oven or by passing a heating current through the wire 416. The wire 416 is bonded to preserve the shape of the preshaped coils with the wire retained in the predetermined positions.

Figure 16:
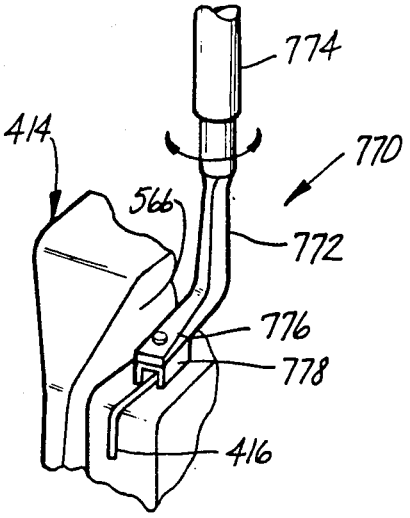
FIG. 16 is a perspective detail view of a portion of an alternative embodiment of a wire placement guide for use with the high voltage coil winding machine.
Figure 16A:
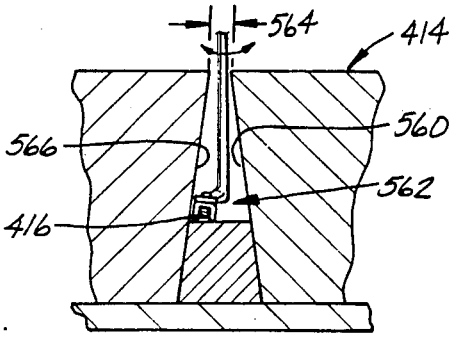
FIG. 16*a* is a sectional detail view of a winding mandrel and the wire placement guide of FIG. 16.

In FIGS. 16 and 16*a*, an alternate embodiment of a wire placement device 770 is illustrated. The wire placement device 770 has a radially-extending shank 772 which is smaller in cross section than the narrowest opening 564 in the pie-shaped annular wire cavity 562 of mandrel 414. The shank 772 is mounted on an arbor 774 which in turn is connected to a drive (not shown) which is adapted to rotationally oscillate the arbor 774 and shank 772 in synchronism with the rotation of mandrel 414 for purposes to be described. The wire placement device 770 is generally L-shaped so as to have a circumferentially-projecting leg 776 disposed within the cavity 562. A wire guide head 778 is pivotedly mounted on the projecting leg 776 for rotation about a radially-extending axis. The wire guide head 778 is preferably a downward-opening U-shaped member having a stud extending from the bight of the U through a bore in the leg 776 which is secured for rotation with respect to the leg by a suitable cap as shown. The side walls of the wire guide head 778 are axially spaced apart so as to be close to the wire 416 but allow free passage of the wire 416 and are preferably as thin as practical to allow close placement of the wire 416 with respect to the converging walls 560 and 566 of the cavity 562.

In the operation of the alternate embodiment of FIGS. 16 and 16*a*, the shank 772 is rotationally oscillated about the axis on shank 772 in synchronism with the rotation of mandrel 414 and to a varied angular amount to position the wire placement head 778 at the desired lateral position within the converging portion of the cavity 562. The angular amount of rotation can be accomplished by a programmed control or by a cam and follower arrangement, the latter attached to a bellcrank connected for rotation with arbor 774. The position of the wire placement head 778 within the converging cavity 562 determines the position of the wire 416 within the cavity 562. Although the thickness of the side walls of the wire placement head 778 establishes the closeness of placement of the wire 416 to the walls 560 and 566, the wire 416 can be moved into contact with the wall 560 or 566 after placement by using a "wedging" turn as described in connection with FIG. 15.

It should be noted that the wire placement head 778 may be greater in axial dimension than the axial width of the narrowest opening 564 of the converging portion of the cavity 562 since the wire placement head 778 may be inserted from the opening at the top or bottom legs and moved into the converging position of cavity 562. It is necessary, however, to dimension the shank 772 so that it can achieve the desired degree of rotation within the confines of the narrowest opening 564.

Figure 17:
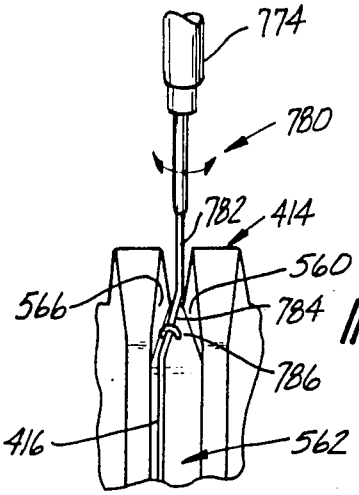
FIG. 17 is a side detail view of another alternative embodiment of a wire placement guide for use with the high voltage coil winding machine.

In FIG. 17, a modified version 780 of the alternate embodiment of a wire placement device is illustrated. The modified alternate embodiment 780 use a round shank 782 having a bend to provide a circumferentially extending leg 784. A U-shaped rod 786 is fixed to the end of the leg 784, preferably by welding or brazing. The U-shaped rod closely conforms to the wire 416 but allows free passage of the wire 416. The modified alternate embodiment 780 operates in essentially the same fashion as the embodiment 770, and consequently, the operation thereof will not be repeated here.

Figure 18:
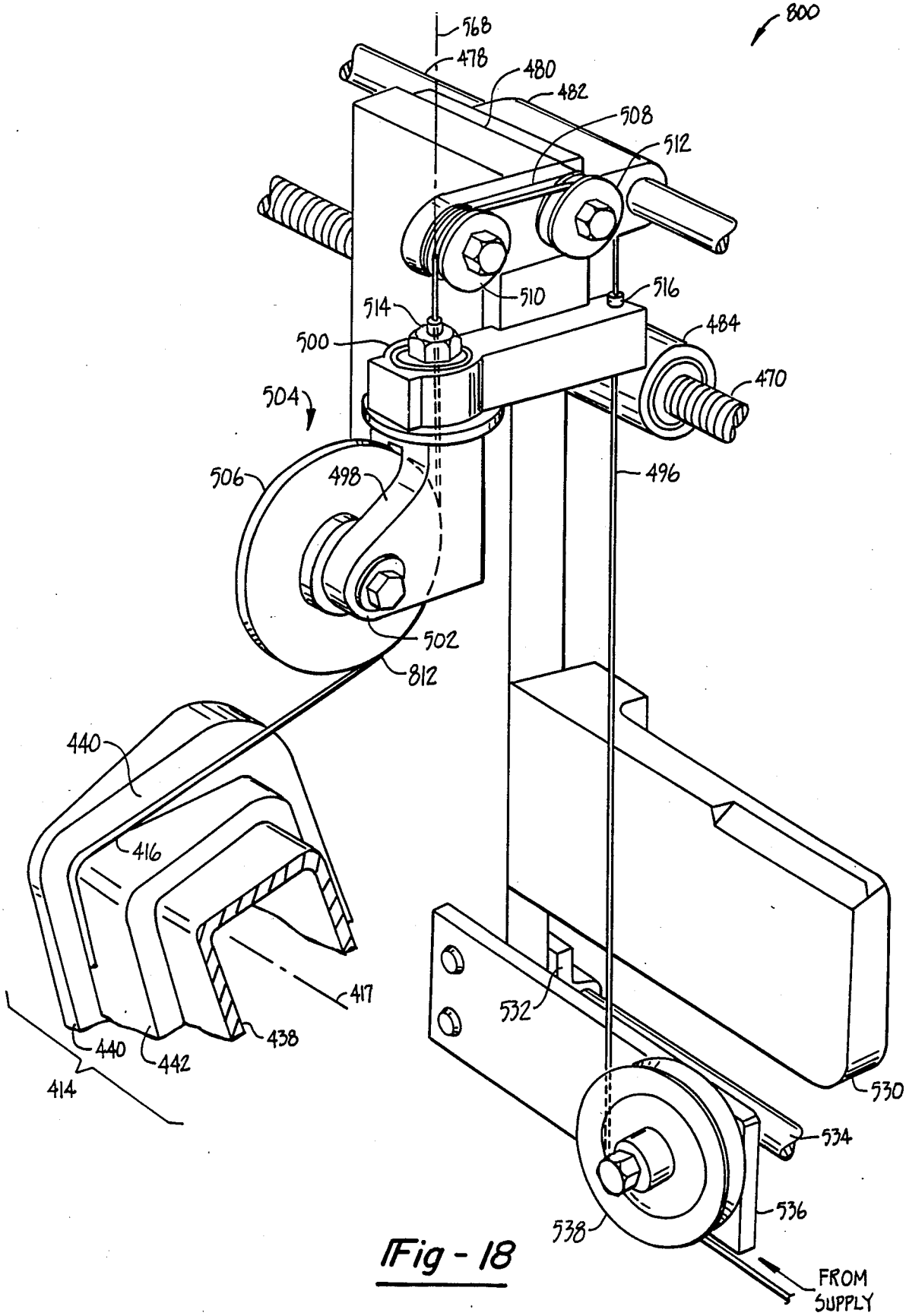
FIG. 18 illustrates a winding head portion of a wire placement subassembly of a further embodiment of the invention.

In FIG. 18, a modified high voltage winding machine 800 is disclosed which does not require that the positioning wheel reside in the pie-shaped winding cavity during winding as illustrated in the previous embodiment 400 of FIGS. 9–17. In most respects, the embodiment 800 is substantially the same as the embodiment 400 of FIGS. 9–17, with components of like configuration and similar function given like numbers.

This further embodiment 800 makes use of a novel principle for positioning the wire during winding into a pie-shaped cavity, including the positioning of the wire within the wire cavity but laterally outside of the narrow entrance 564 of the wire cavity on the inside leg of the winding. It will be noted that the prior embodiment used a wire placement wheel 504 or other wire positioning means which extended into the wire cavity. For example, when winding the wire 416 into the undercut inside leg of the wire cavity, the groove 506 of the wire 416 placement wheel 504 was positioned laterally outside of the narrow entrance 564 of the wire cavity at the location within the wire cavity at which the wire 416 is to be located. In the present embodiment, such positioning of the wire at positions which are laterally outside of the narrow entrance 564 of the undercut inside leg of the wire cavity is accomplished through the principle described herein without requiring any portion of the wire placement wheel 504 to enter the wire cavity. This is generally illustrated in FIG. 18 by the wire placement wheel 504 which is located outside of a wire cavity 562 having side walls 560 and 566.

The high voltage winding machine 800 of FIGS. 18 through 23 differs from the previously-disclosed embodiment of FIGS. 9 through 17 in that the radial lift mechanism using rotating cam 52 and cam follower 494 has been disabled, or alternatively removed, to fix the radial position of wheel 504, and additionally, the tilt mechanism which tilts the tilt axis shaft 488 about tilt axis 497 has also been disabled, or alternatively removed, so that wheel 504 remains in a vertical plane. The traversing mechanism which rotates traversing screw 470 to move collar 484 and wheel 506 laterally in accordance with pre-programmed motions had not been disabled, although it has been reprogrammed in accordance with the principles stated herein. Additionally, the castering mechanism which allows caster arm 498 to caster about a caster axis 568 is still functional but the caster is limited to several degrees of motion. In all other material respects, the embodiment 800 of FIGS. 18–23 is the same as the embodiment 400 of FIGS. 9–17.

Figure 19A:
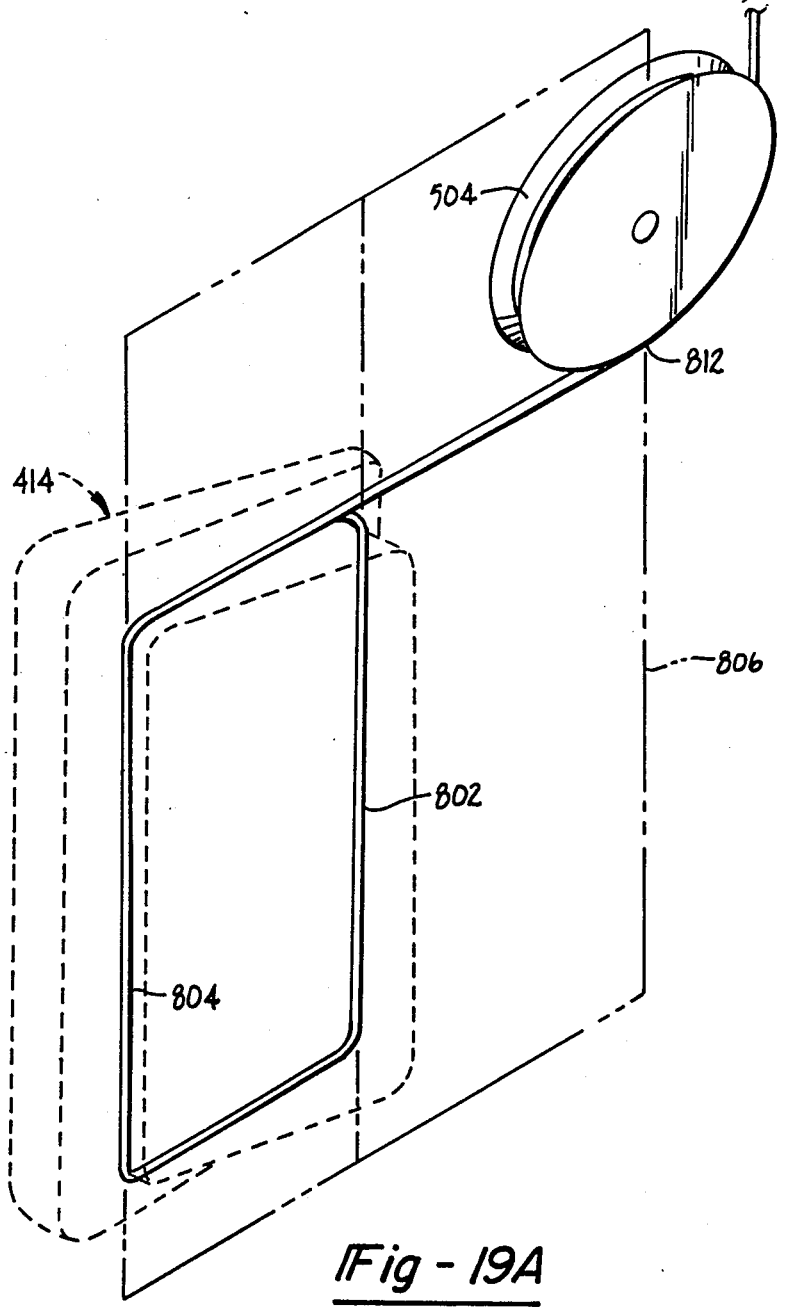
FIGS. 19A and 19B illustrate the principle behind the preferred placement of the wire within the cavity according to the embodiment of FIG. 18.
Figure 19B:
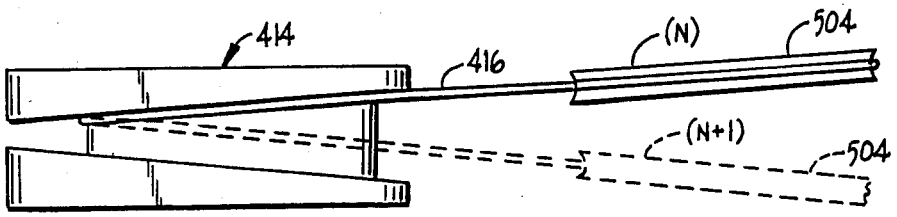

With reference to FIGS. 19A and 19B, the principle on which the embodiment 800 operates will now be discussed. The wire placement wheel 504, or other wire positioning means, is located with its wire dispensing point in a plane 806 which is defined by the inside and outside legs of the turn being wound. This principle is best illustrated in FIGS. 19A and 19B. As is known, two straight parallel lines will define a plane. In this case, the radially-inside leg 802 and radially-outside leg 804 of the current turn defines the plane 806 of interest.

The wheel 504 is programmed to traverse back and forth along the axis of rotation of the mandrel 414 during winding of each coil such that, at certain portions of the winding cycle, the point 812 of departure of the wire 416 from the groove 506 lies in the plane 806 defined by the radially-inside leg 802 and the radially-outside leg 804 of the current turn being wound. It is not necessary, however, that the entire wheel 504 be in plane 806. By keeping the departure point 812 of the wire 416 from the wheel 504 in the plane 806, the tensioning of the wire during winding allows the wire to be placed within the wire cavity on the inside leg of the winding, but actually laterally outside of the narrow entrance 564 of the inside leg of the wire cavity. While it is counter-intuitive that the wire 416 can be positioned laterally outside of the narrow entrance 564 of the inside leg of the wire cavity through winding tension alone, this result has been actually achieved in practice. Surprisingly, this result is achieved by a positioning of the winding wheel 504 which at times is also counter-intuitive. Particularly, when comparing the positioning of the winding wheel 506 during winding of the inside leg on respective turns having significantly different amounts of tilt of the plane of the turns, the winding wheel 506 may be placed a lesser distance from the center of the wire cavity to position the inside leg a greater distance laterally of the center of the wire cavity when the tilt of the plane of the turn is a lesser amount. This apparently illogical result occurs since the winding wheel 506 or other wire guide is positioned, not on the basis of the location of the inside leg alone, but rather on the basis of the location of both the inside leg and the outside leg. Consequently, the same laterally position of the inside leg of the winding can be effected by different lateral positions of the wire guide depending upon the location of the outside leg.

With reference to FIGS. 19A and 19B, since many of the turns lie in planes which are tilted relative to the axis 417 of rotation of the winding mandrel 414, the winding wheel 504 must traverse back and forth in a sinusoidal-like motion as the mandrel 414 rotates to keep the departure point of the wire 416 from the groove 506 located within the rotating tilted plane of the turn being wound, at least during certain portions of the winding cycle as will be described. While the sinusoidal-like motion need not be duplicated exactly in order to achieve the results of the invention, the wheel 504 should be caused to traverse left and right along the axis 417 of rotation of the mandrel 414 to generally approximate that sinusoidal-like motion, at least during winding of the converging yoke and the inside leg, with the degree of departure from the true sinusoidal-like motion determining the accuracy with which the wire 416 is layed within the wire cavity, at least during those portions of the winding cycle in which sinusoidal motion is desired. As will be described in more detail hereinafter, the computer program for controlling the traversing motion of the wheel 504 is adapted so that a number of points may be defined along the theoretically-perfect sinusoidal-like motion with a rate of traverse of the wheel 504 being defined between such points to generally simulate the sinusoidal-like motion of the wheel 504. Such computer programs which are used for a numerical control of machine tools are well known and widely available.

The winding method of the embodiment 800, since it does not position the wheel 504 within the winding cavity gives rise to certain preferred principles of operation of the winding method which include the following:

1. All of the inside legs and outside legs of the turns of a coil should lie in parallel. That is to say, there should be no crossover of the wire 416 at the inside or outside legs of the coil.

2. The wire 416 should be oriented radially when the converging yoke is wound. The term "radially" in this context generally means radially with respect to the point (shown in FIG. 21B at 820) of convergence of the side walls 560 and 566 of the wire cavity, or in the case of wire cavities in which the narrow entrance 564 has a width which is substantially the diameter of the wire 416, radially with respect to the mid-point (shown in FIG. 21B at 822) of the narrow entrance 564. The term "converging yoke" means the yoke in which the walls 560 and 566 converge in the direction of winding of the wire 416. This recommendation allows the wire 416 to clear the converging walls 560 and 566 when the winding of the converging yoke portion is near completion and the wire must be directed through the narrow entrance 564 as it is led from the winding wheel 504.

3. In view of recommendations 1. and 2., all crossovers of the wire 416 which are required to transition from one winding plane to another winding plane should occur while the wire traverses the diverging yoke. The term "diverging yoke" refers to the yoke in which the walls 560 and 566 diverge in the direction of winding of the wire 416.

4. The position of the wire at the end of the diverging yoke is established to define the plane of the next turn to be wound. This is a result of the fact that the inside and outside legs are defined as lying parallel in plane 806 and the converging yoke is defined as radial preventing any adjustment in the plane of winding of the next turn during those portions of the turn. Consequently, any changes in the placement pattern of the windings is implemented by adjusting the position of the wire 416 (through traverses of the wheel 504) during the winding of the diverging yoke. This is illustrated in FIG. 19B in which the wheel 504 is illustrated in solid lines to signify the position of the wheel after winding the inside leg of turn (N) and in dashed lines to signify the position of the wheel prior to winding the outside leg of turn (N+1). The winding pattern should be set to establish the most compact coil volume, and preferably, to limit the dielectric stress between turns. For example, dielectric stresses are limited by separating turns which are significantly spaced in the winding sequence. As an extreme, the dielectric stress is maximum between the first turn of the coil and the last turn of the coil.

As a general matter, the winding tension must be maintained sufficiently high to prevent slippage or lateral movement of the wire 416 after it has engaged the mandrel (or underlying turns of wire) during positioning traverses of the winding wheel 504. Otherwise, the wire 416, after it is laid in place, will slip out of the desired plane being established for the instant turn.

During winding of the coil, one layer of winding must be generally completed before a turn in the next layer can be wound since the turn being wound would tend to push apart the turns of an incompleted layer. It is also preferred to plan crossovers so that the angle of intersection of the crossover wire with the previous turn is large enough to prevent substantial guiding along the previous turn which would prevent the crossover. Other physical placement considerations during winding of the turns of a coil will be apparent to one of ordinary skill in the art and need not be described in detail here.

Figure 20A:
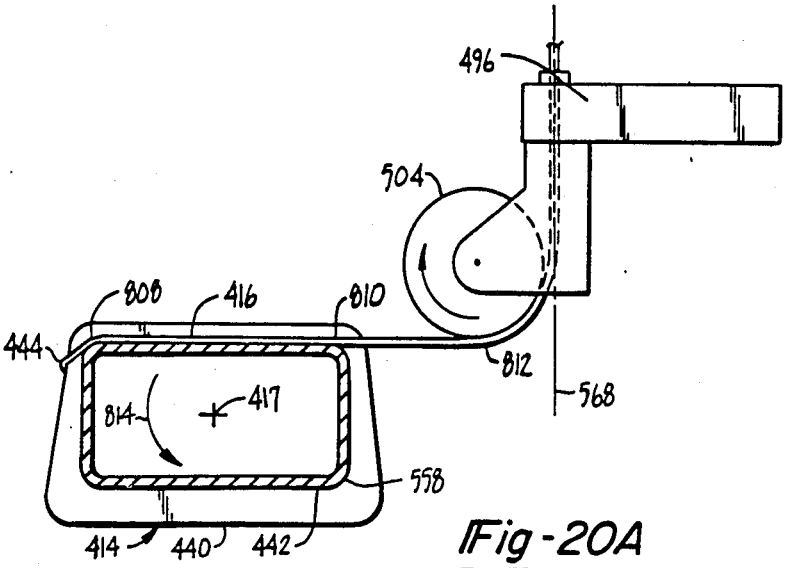
FIGS. 20A and 20B, 21A and 21B, 22A and 22B, and 23A and 23B show side and top views of the winding mandrel and wire positioning wheel at various rotary positions to the end of a turn in FIGS. 23A and 23B.
Figure 20B:
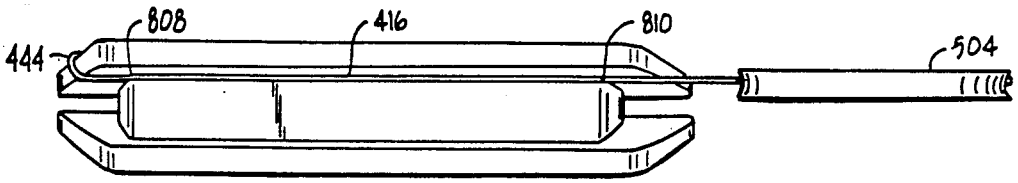

In FIGS. 20A and 20B, the winding of the start of a turn according to this new principle is illustrated. FIGS. 20A and 20B show the start of a turn with the wire 416 coming from the previous coil at 444. Although not shown, the form 440 may be notched at this point to facilitate the crossover. Note that the outside leg of the first turn is being wound with the wire 416 traversing the outside leg from point 808 to point 810, each of which is located at a lateral extremity of the outside leg of the wire cavity (shown upwardly disposed in the cavity in FIG. 20B). The computer program which positions wheel 504 has positioned the departure point 812 of the wheel 504 in a plane determined by the line passing between points 808 and 810 and a line predefined in the computer program which represents the line (shown between points 824 and 826 in FIGS. 22A and 22B) which the wire 416 will occupy when the inside leg of the current turn is wound. As previously noted, it is not necessary that the entire wheel 504 lie in this plane but only the departure point 812 where the wire 416 leaves the peripheral groove 506 of the wheel 504. Moreover, in view of the fact that the outside leg of the wire cavity has diverging cavity walls, allowing a substantial degree of freedom of the wheel 504 without causing interference with the cavity walls, positioning of the departure point 812 is not critical with respect to the outside leg. Accordingly, the departure point 812 may be conveniently placed, if desired, in a plane perpendicular to the axis 417 of rotation of the mandrel 414 which contains the segment of wire 416 between points 808 and 810. As can be seen from the figure, even when the departure point 812 is positioned in such a perpendicular plane containing the outside leg segment, the wire 416 will be accurately positioned between points 808 and 810.

Figure 21A:
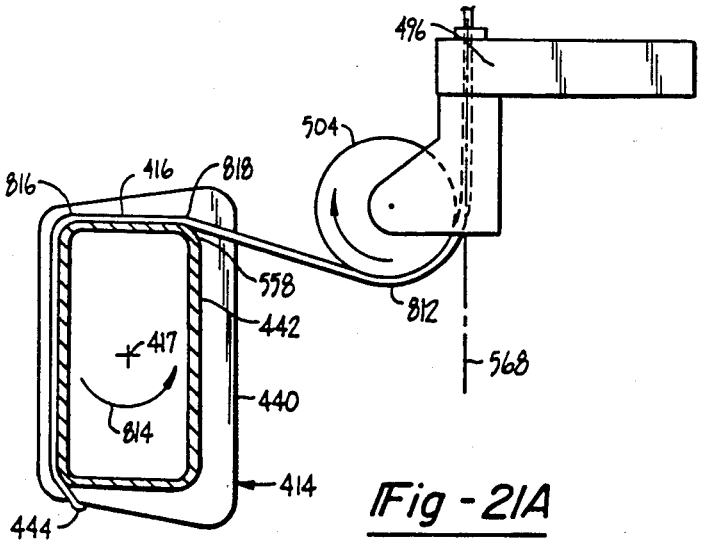
Figure 21B:
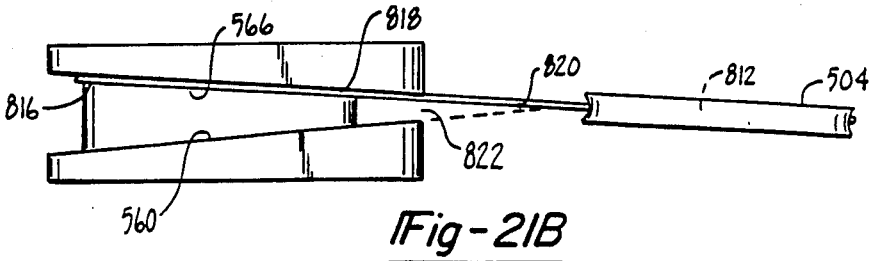

After the wire is positioned as shown in FIGS. 20A and 20B, the mandrel 414 rotates in the direction of arrow 814 about axis 417 of the mandrel 414 until it is positioned as illustrated in FIGS. 21A and 21B. In FIGS. 21A and 21B, the converging yoke of the turn is being wound from point 816 to point 818. Note that the converging walls 560 and 566 of the wire cavity converge at a point 820 in front of the mandrel 414. The departure point 812 of the wheel 504 is established by traverse of the departure point 812 of the wheel 504 downwardly in FIG. 21B so that the line of the wire 416 from point 816 to point 818 passes through the point of convergence 820 of the converging walls 560 and 566. This relationship is established so that the wire 416 clears the walls 560 and 566 where the walls define a narrow entrance or undercut opening to the inside leg of the wire cavity. In this regard, since the wire 416 passes through point 820, it can be deemed to be radially positioned relative to point 820, and as such, will clear the converging sides 560 and 566 of the wire cavity. When the narrow opening 822 of the converging sides 560 and 566 at the inside leg of the wire cavity is substantially the same size as the diameter of wire 416, it is preferable to deem that the convergent point 820 is located at the midpoint of the narrow opening 822 of the inside leg of the wire cavity. By this means, the wire 416 will again be assured of clearing the converging sides 560 and 566 of the wire cavity. With regard to FIG. 21B, note that the starting point 816 of the converging yoke, the ending point 818 of the converging yoke, the converging point 820 and the departure point 812 of the wheel 504 are all in line.

Figure 22A:
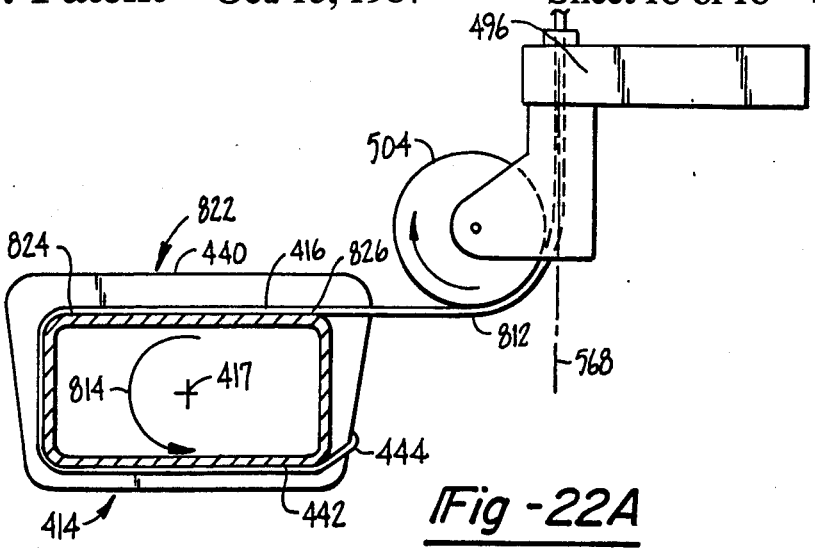
Figure 22B:
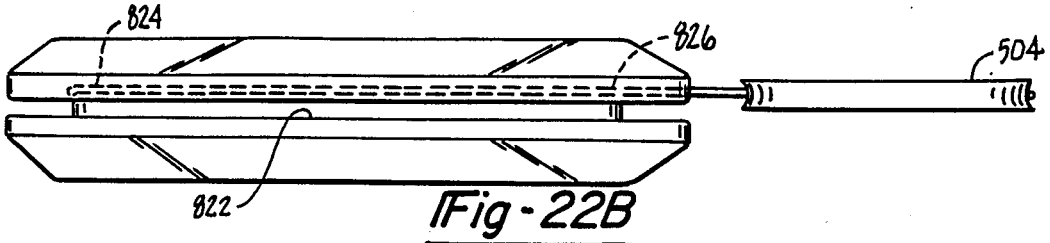

In FIGS. 22A and 22B, the winding of the instant turn of the wire 416 is continued by further rotation of the mandrel 414 about axis 417 in the direction of arrow 814. In FIGS. 22A and 22B, the winding of the inside leg of the turn is illustrated from point 824 to point 826. The line defined by the points 824 and 826 representing the inside leg of the instant turn and the line defined by points 808 and 810 representing the outside leg of the instant turn together define the plane in which the departure point 812 of the wire 416 from the peripheral groove 506 of wheel 504 is located during the winding of the inside leg of the turn. To accomplish the winding of the inside leg, the point of departure 812 has moved traversely, downwardly in FIG. 22B, relative to the position 812 in FIG. 21B. It should be noted that at times the departure point 812 is located contrary to normal intuition. For example, on the next turn, the departure point 812 may be located at a lower position to place the wire at a relatively upward (as seen in FIG. 22B) position within the converging wire cavity for the inside leg compared to the previous turn since the position of the departure point is a function of the positions of two legs, the inside and outside legs, and not simply a function of the position of the inside leg. It should also be noted that the wire 814 has been positioned laterally outside of the narrow entrance 822 of the wire cavity at the inside leg.

Figure 23A:
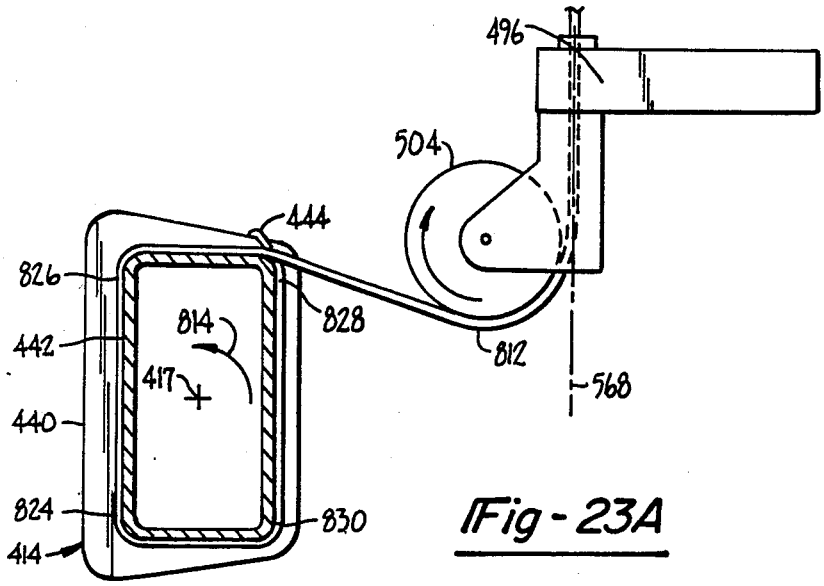
Figure 23B:
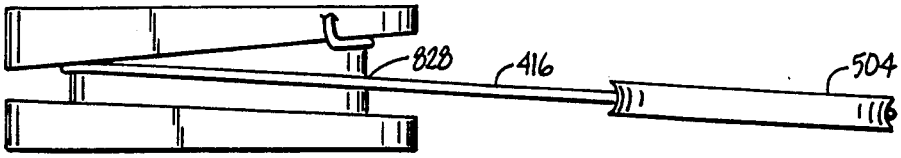

In FIGS. 23A and 23B, the mandrel 414 has continued to rotate in the direction of arrow 814 about axis 417 so as to position the mandrel 414 to wind the divergent leg of the turn presently being wound. As previously indicated in connection with FIG. 19B, the divergent leg provides freedom to make transitions between the plane of the previous turn (N) to the plane of the next turn (N+1). For the purpose of winding the diverging yoke, the departure point 812 of the wheel 504 is positioned in a plane defined by the line of the inside leg of the previous turn between points 824 and 826 and the line of the outside leg of the next turn between points 828 and 830 (shown only in FIG. 23A). By this means, the wire 416 is caused to transition between the plane of the earlier turn and the plane of the next turn, crossing over any wire which lies in its path. As can be seen from FIG. 23B, the diverging walls of the wire cavity at the outside leg permits the wire 416 to be readily directed in nonparallel, nonradial directions. Thereafter, the next turn is wound using the same principles described above.

As previously described, the positioning of the departure point 812 of the wheel 504 can be accomplished through known numerical control programs by establishing a series of points, e.g. ten, during the rotational cycle of the mandrel 414 at which the departure point 812 of the wheel 504 will be located during rotation of the mandrel 814. Preferably, these points lie along the ideal sinusoidal path defined by the rotation of the tilted plane in which the inside and outside legs of a turn lie. Additionally, transition rates are established for the departure point 812 of the wheel 504 between these points which approximate the sinusoidal motion of the tilted plane as it rotates. In essence, the departure point 812 is caused to remain in the tilted plane as it rotates with rotation of the mandrel 414. These ten points, in one exemplary embodiment, were located near the start and end of the winding of each of the four legs, and one additional point was located at each midpoint of the winding of the inside leg and the midpoint of the winding of the diverging yoke leg.

While in the exemplary embodiment, the mandrel rotates while the guide wheel or means 504 is non-rotatable, it will be appreciated that the machine can be modified to cause the guide wheel or means 504 to rotate about a non-rotatable mandrel while still utilizing the principles of the present invention.

The foregoing discussion discloses and describes merely exemplary methods and embodiments of the present invention. One skilled in the art will readily recognize from such discussion that various changes, modifications and variations may be made therein without departing from the spirit and scope of the invention described in the following claims.

What is claimed is:

1. An apparatus for winding wire into pieshaped coil bundles, said apparatus comprising:

a winding mandrel providing a bottom wall and two side walls defining an annular cavity for containing multiple turns of the wire with each turn having an inside leg, an outside leg, a converging yoke and a diverging yoke corresponding to an inside leg portion, an outside leg portion, a converging yoke portion and a diverging yoke portion of said annular cavity, said side walls converging toward a narrow opening to said annular cavity at said inside leg portion of said annular cavity so as to provide an undercut cavity portion;

guide means for axially positioning the wire during relative rotation of said guide means and said winding mandrel to wind the wire into said annular cavity, said guide means including a positioning portion located outside said annular cavity cooperating with the wire for placing the wire at predetermined axial positions laterally of said narrow opening within said undercut portion of said annular cavity; and adjusting means for adjusting the axial location of said positioning portion of said guide means during winding of a turn so that said inside leg and said outside leg of said turn being wound are caused to substantially lie in a predetermined plane, said adjusting means adjusting the axial location of said positioning portion of said guide means for at least the winding of a portion of said turn generally in accordance with said predetermined plane to adjust said predetermined axial positions of the wire within said undercut portion of said annular cavity.

2. An apparatus for winding wire into pieshaped coil bundles, said apparatus comprising:

a winding mandrel providing a bottom wall and two side walls defining an annular cavity for containing multiple turns of the wire with each turn having an inside leg, an outside leg, a converging yoke and a diverging yoke corresponding to an inside leg portion, an outside leg portion, a converging yoke portion and a diverging yoke portion of said annular cavity, said side walls converging toward a narrow opening to said annular cavity at said inside leg portion of said annular cavity so as to provide an undercut cavity portion;

guide means for axially positioning the wire during relative rotation of said guide means and said winding mandrel to wind the wire into said annular cavity, said guide means including a positioning portion located outside said annular cavity cooperating with the wire for placing the wire at predetermined axial positions laterally of said narrow opening within said undercut portion of said annular cavity; and adjusting means for adjusting the axial location of said positioning portion of said guide means during winding of a turn so that all of said inside legs and said outside legs are disposed in parallel and said converging legs are radially disposed with respect to a predetermined point.

3. An apparatus as recited in claim 2 where said predetermined point is substantially the point of convergence of said side walls.

4. An apparatus as recited in claim 2 where said predetermined point is substantially the mid-point of said narrow opening.

5. An apparatus for winding wire into pieshaped coil bundles, said apparatus comprising:

a winding mandrel providing a bottom wall and two side walls defining an annular cavity for containing multiple turns of the wire with each turn having an inside leg, an outside leg, a converging yoke and a diverging yoke corresponding to an inside leg portion, an outside leg portion, a converging yoke portion and a diverging yoke portion of said annular cavity, said side walls converging toward a narrow opening to said annular cavity at said inside leg portion of said annular cavity so as to provide an undercut cavity portion;

guide means for axially positioning the wire during relative rotation of said guide means and said winding mandrel to wind the wire into said annular cavity, said guide means including a positioning portion located outside said annular cavity cooperating with the wire for placing the wire at predetermined axial positions laterally of said narrow opening within said undercut portion of said annular cavity; and adjusting means for adjusting the axial location of said positioning portion of said guide means during winding of a turn so that said inside leg and said outside leg of said turn are disposed in respective predetermined positions, said adjusting means positioning said guide means during winding of said converging leg in accordance with said predetermined positions of said inside leg and said outside leg.

6. An apparatus as recited in claims 1, 2 or 5 wherein said positioning guide means includes a positioning wheel confronting said annular cavity and carrying the wire on a portion of the periphery thereof.

7. An apparatus as recited in claim 6 wherein said positioning guide means further includes caster mounting means for rotatably mounting said positioning wheel about a caster axis substantially orthogonal to said mandrel axis to allow said positioning wheel to caster.

8. An apparatus as recited in claims 1, 2 or 5 wherein said adjusting means includes carriage means for carrying said guide means along a path substantially parallel to said mandrel axis, and also includes carriage drive means for moving said carriage means along said path to enable said guide means to axially position the wire within said annular cavity.

* * * * *